US011767853B2

(12) United States Patent
Horton et al.

(10) Patent No.: US 11,767,853 B2
(45) Date of Patent: Sep. 26, 2023

(54) NOZZLE FOR A FAN ASSEMBLY

(71) Applicant: Dyson Technology Limited, Wiltshire (GB)

(72) Inventors: Lucy Horton, Bristol (GB); Timothy Neil Jukes, Swindon (GB); Charles Edward Pouget, Swindon (GB); Joseph Robert Carling, Swindon (GB); Ryan Alexander Hughes, Bristol (GB); Steven Eduard Peet, Bristol (GB); Peter Harley, Malmesbury (GB)

(73) Assignee: Dyson Technology Limited, Malmesbury (GB)

( * ) Notice: Subject to any disclaimer, the term of this patent is extended or adjusted under 35 U.S.C. 154(b) by 312 days.

(21) Appl. No.: 17/287,918

(22) PCT Filed: Oct. 8, 2019

(86) PCT No.: PCT/GB2019/052834
§ 371 (c)(1),
(2) Date: Apr. 22, 2021

(87) PCT Pub. No.: WO2020/089581
PCT Pub. Date: May 7, 2020

(65) Prior Publication Data

US 2021/0381518 A1 Dec. 9, 2021

(30) Foreign Application Priority Data

Nov. 1, 2018 (GB) ..... 1817852

(51) Int. Cl.
*F04D 25/08* (2006.01)
*F04F 5/46* (2006.01)
(Continued)

(52) U.S. Cl.
CPC ..... *F04D 25/10* (2013.01); *F04D 25/12* (2013.01); *F04D 29/403* (2013.01);
(Continued)

(58) Field of Classification Search
CPC ..... F04D 25/08; F04D 25/10; F04F 5/461; F24F 13/06; F24F 13/065; F24F 13/10
See application file for complete search history.

(56) References Cited

U.S. PATENT DOCUMENTS 2,488,467 A 11/1949 De Lisio
3,362,494 A 1/1968 Boehler et al.
(Continued)

FOREIGN PATENT DOCUMENTS

CN 2185861 Y 12/1994
CN 1993243 A 7/2007
(Continued)

OTHER PUBLICATIONS

English Translation of WO-2018058892-A 1 (Fei) obtained Mar. 9, 2023 (Year: 2018).
(Continued)

*Primary Examiner* — Long T Tran
(74) *Attorney, Agent, or Firm* — Faegre Drinker Biddle & Reath LLP

(57) ABSTRACT

There is provided a nozzle for a fan assembly. The nozzle comprises an air inlet, a first air outlet and a second air outlet that are oriented in convergent directions, and a valve for controlling the first and second air outlets. The valve comprises one or more valve members that are moveable to simultaneously adjust the size of the first air outlet and inversely adjust the size of the second air outlet. The nozzle further comprises a third air outlet and a fourth air outlet, the third air outlet being opposite the fourth air outlet, the third and fourth air outlets being oriented in convergent direc-
(Continued)

tions, and the third air outlet and the fourth air outlet each being substantially perpendicular to each of the first and second air outlets.

28 Claims, 17 Drawing Sheets

(51) Int. Cl.

| | |
|---|---|
| ***F24F 13/10*** | (2006.01) |
| ***F04D 25/10*** | (2006.01) |
| ***F04D 25/12*** | (2006.01) |
| ***F04D 29/40*** | (2006.01) |
| ***F04D 29/52*** | (2006.01) |
| ***F04D 29/56*** | (2006.01) |
| *F24F 13/065* | (2006.01) |

(52) U.S. Cl.
CPC ..... *F04D 29/524* (2013.01); *F04D 29/563* (2013.01); *F24F 13/065* (2013.01); *F24F 13/10* (2013.01)

(56) References Cited

U.S. PATENT DOCUMENTS

| | | | | |
|---|---|---|---|---|
| 3,774,262 | A * | 11/1973 | Anthony | A47L 11/34 15/345 |
| 3,823,653 | A | 7/1974 | Roos | |
| 4,220,145 | A * | 9/1980 | Stamp | B05B 3/0427 601/169 |
| 4,395,201 | A | 7/1983 | Bron | |
| 5,411,371 | A | 5/1995 | Chen | |
| 5,524,827 | A | 6/1996 | Znamensky et al. | |
| 5,821,475 | A | 10/1998 | Morehead et al. | |
| 6,156,085 | A | 12/2000 | Chiu et al. | |
| 6,341,760 | B1 * | 1/2002 | Rawlings | F16K 7/17 251/207 |
| 8,308,445 | B2 | 11/2012 | Gammack et al. | |
| 2008/0014855 | A1 | 1/2008 | Leserre | |
| 2009/0047892 | A1 | 2/2009 | Brancheriau et al. | |
| 2010/0014959 | A1 | 1/2010 | Azzouz et al. | |
| 2012/0034108 | A1 | 2/2012 | Wallace et al. | |
| 2012/0051884 | A1 | 3/2012 | Junkel et al. | |
| 2012/0263573 | A1 * | 10/2012 | Tadokoro | F04D 29/283 415/53.1 |
| 2013/0104415 | A1 * | 5/2013 | Han | A45D 20/00 34/283 |
| 2013/0280051 | A1 | 10/2013 | Nicolas et al. | |
| 2014/0210114 | A1 | 7/2014 | Staniforth et al. | |
| 2014/0255173 | A1 | 9/2014 | Poulton et al. | |
| 2014/0286747 | A1 | 9/2014 | Fang et al. | |
| 2014/0348658 | A1 | 11/2014 | Cunnane | |
| 2015/0300663 | A1 * | 10/2015 | Hirakawa | F24F 1/0011 165/104.34 |
| 2016/0121695 | A1 | 5/2016 | Sakurai | |
| 2016/0152116 | A1 | 6/2016 | Albin et al. | |
| 2017/0087500 | A1 | 3/2017 | Combs et al. | |
| 2017/0094903 | A1 * | 4/2017 | Baes | A01F 12/48 |
| 2017/0190240 | A1 | 7/2017 | Paris | |
| 2018/0064303 | A1 * | 3/2018 | Meggle | A47L 9/1409 |
| 2018/0080676 | A1 | 3/2018 | Cho et al. | |
| 2018/0353923 | A1 * | 12/2018 | Hoener | B65G 53/4641 |
| 2019/0118340 | A1 * | 4/2019 | Mase | B22F 10/20 |
| 2020/0178749 | A1 * | 6/2020 | Royale | A47L 11/34 |
| 2021/0270282 | A1 | 9/2021 | MacQueen et al. | |
| 2021/0270283 | A1 | 9/2021 | MacQueen et al. | |
| 2021/0270284 | A1 | 9/2021 | Jukes et al. | |
| 2021/0270292 | A1 | 9/2021 | MacQueen | |
| 2023/0028614 | A1 | 1/2023 | Marcel et al. | |

FOREIGN PATENT DOCUMENTS

| | | | |
|---|---|---|---|
| CN | 101649842 | A | 2/2010 |
| CN | 101985949 | A | 3/2011 |
| CN | 102235385 | A | 11/2011 |
| CN | 103133300 | A | 6/2013 |
| CN | 203272264 | U | 11/2013 |
| CN | 103807149 | A | 5/2014 |
| CN | 203627312 | U | 6/2014 |
| CN | 203770175 | U | 8/2014 |
| CN | 204084763 | U | 1/2015 |
| CN | 104895768 | A | 9/2015 |
| CN | 105041625 | A | 11/2015 |
| CN | 105508311 | A | 4/2016 |
| CN | 105644302 | A | 6/2016 |
| CN | 106123272 | A | 11/2016 |
| CN | 106286327 | A | 1/2017 |
| CN | 206035913 | U | 3/2017 |
| CN | 106573522 | A | 4/2017 |
| CN | 106884815 | A | 6/2017 |
| CN | 106969482 | A | 7/2017 |
| CN | 207317217 | U | 5/2018 |
| CN | 210829911 | U | 6/2020 |
| CN | 211174828 | U | 8/2020 |
| CN | 211231040 | U | 8/2020 |
| CN | 211343521 | U | 8/2020 |
| CN | 211901107 | U | 11/2020 |
| DE | 10350949 | A1 | 11/2004 |
| DE | 102015001477 | A1 | 12/2015 |
| DE | 102015116242 | B3 | 9/2016 |
| DE | 102016107227 | A1 | 10/2017 |
| EP | 0610866 | A1 | 8/1994 |
| EP | 3321114 | A1 | 5/2018 |
| FR | 2772311 | A1 | 6/1999 |
| FR | 3034175 | A1 | 9/2016 |
| GB | 1347978 | A | 2/1974 |
| GB | 2463698 | A | 3/2010 |
| GB | 2482549 | A | 2/2012 |
| GB | 2493672 | A | 2/2013 |
| GB | 2496464 | A | 5/2013 |
| GB | 2499042 | A | 8/2013 |
| GB | 2502103 | A | 11/2013 |
| JP | S61-195235 | A | 8/1986 |
| JP | S61-195235 | U | 12/1986 |
| JP | 2009-204240 | A | 9/2009 |
| JP | 2012-145308 | A | 8/2012 |
| JP | 2014-088774 | A | 5/2014 |
| JP | 2014-234936 | A | 12/2014 |
| JP | 5663051 | B2 | 2/2015 |
| JP | 2015-175309 | A | 10/2015 |
| KR | 10-0225915 | B1 | 7/1999 |
| KR | 10-1601325 | B1 | 3/2016 |
| KR | 10-1647382 | B1 | 8/2016 |
| KR | 10-1735432 | B1 | 5/2017 |
| TW | 336963 | | 8/1999 |
| WO | 99/07569 | A1 | 2/1999 |
| WO | 2010/100451 | A1 | 9/2010 |
| WO | 2013/035271 | A1 | 3/2013 |
| WO | 2014/075399 | A1 | 5/2014 |
| WO | 2017/050754 | A1 | 3/2017 |
| WO | 2018/058892 | A1 | 4/2018 |
| WO | 2020/089581 | A1 | 5/2020 |

OTHER PUBLICATIONS

Fei et al., WO 2018/058892, 2018, English Machine Translation (Year: 2018).

Office Action received for Patent Application No. KR 10-2021-7000200, dated May 20, 2022, 13 pages (7 pages of English Translation and 6 pages of Original Document).

Office Action received for Patent Application No. KR 10-2021-7000470, dated May 20, 2022, 11 pages (6 pages of English Translation and 5 pages of Original Document).

International Search Report and Written Opinion received for PCT Patent Application No. PCT/GB2019/051712, dated Sep. 24, 2019, 9 pages.

International Search Report and Written Opinion received for PCT Patent Application No. PCT/GB2019/051713, dated Sep. 25, 2019, 9 pages.

International Search Report and Written Opinion received for PCT Patent Application No. PCT/GB2019/051714, dated Sep. 24, 2019, 9 pages.

(56) References Cited

OTHER PUBLICATIONS

International Search Report and Written Opinion received for PCT Patent Application No. PCT/GB2019/051715, dated Oct. 2, 2019, 8 pages.
Office Action received for Chinese Patent Application No. 201910559580.0, dated Jul. 2, 2021, 22 pages (14 pages of English Translation and 8 pages of Original Document).
Office Action received for Chinese Patent Application No. 201910566663.2, dated Jul. 2, 2021, 25 pages (15 pages of English Translation and 10 pages of Original Document).
Search Report dated Dec. 10, 2018, directed to GB Application No. 1810538.7; 1 page.
Search Report dated Dec. 10, 2018, directed to GB Application No. 1810539.5; 1 page.
Search Report dated Dec. 19, 2018, directed to GB Application No. 1810540.3; 1 page.
Search Report dated Dec. 19, 2018, directed to GB Application No. 1810541.1; 1 page.
The First Office Action dated Dec. 7, 2020, directed to CN Application No. 201910559831.5; 18 pages.
The First Office Action dated Oct. 12, 2020, directed to CN Application No. 201910559580.0; 16 pages.
The First Office Action dated Oct. 12, 2020, directed to CN Application No. 201910566663.2; 13 pages.
Evaluation Report dated Nov. 16, 2020, directed to CN Application No. ZL2019218644124; 13 pages.
International Search Report and Written Opinion dated Dec. 17, 2019, directed to International Application No. PCT/GB2019/052834; 11 pages.
Search Report dated Apr. 30, 2019, directed to GB Application No. 1817852.5; 1 page.
The First Office Action dated May 6, 2021, directed to CN Application No. 201911050925.6; 15 pages.
Singapore Search Report and Written Opinion Received for SG Application No. 11202009931S, dated May 20, 2022, 8 pages.

* cited by examiner

NOZZLE FOR A FAN ASSEMBLY

REFERENCE TO RELATED APPLICATIONS

This application is a national stage application under 35 USC 371 of International Application No. PCT/GB2019/052834, filed Oct. 8, 2019, which claims the priority of United Kingdom Application No. 1817852.5, filed Nov. 1, 2018, the entire contents of each of which are incorporated herein by reference.

FIELD OF THE DISCLOSURE

The present invention relates to a nozzle for a fan assembly, and a fan assembly comprising such a nozzle.

BACKGROUND OF THE DISCLOSURE

A conventional domestic fan typically includes a set of blades or vanes mounted for rotation about an axis, and drive apparatus for rotating the set of blades to generate an airflow. The movement and circulation of the airflow creates a 'wind chill' or breeze and, as a result, the user experiences a cooling effect as heat is dissipated through convection and evaporation. The blades are generally located within a cage which allows an airflow to pass through the housing while preventing users from coming into contact with the rotating blades during use of the fan.

U.S. Pat. No. 2,488,467 describes a fan which does not use caged blades to project air from the fan assembly. Instead, the fan assembly comprises a base which houses a motor-driven impeller for drawing an airflow into the base, and a series of concentric, annular nozzles connected to the base and each comprising an annular outlet located at the front of the nozzle for emitting the airflow from the fan. Each nozzle extends about a bore axis to define a bore about which the nozzle extends.

Each nozzle is in the shape of an airfoil may therefore be considered to have a leading edge located at the rear of the nozzle, a trailing edge located at the front of the nozzle, and a chord line extending between the leading and trailing edges. In U.S. Pat. No. 2,488,467 the chord line of each nozzle is parallel to the bore axis of the nozzles. The air outlet is located on the chord line, and is arranged to emit the airflow in a direction extending away from the nozzle and along the chord line.

Another fan assembly which does not use caged blades to project air from the fan assembly is described in WO 2010/100451. This fan assembly comprises a cylindrical base which also houses a motor-driven impeller for drawing a primary airflow into the base, and a single annular nozzle connected to the base and comprising an annular mouth/outlet through which the primary airflow is emitted from the fan. The nozzle defines an opening through which air in the local environment of the fan assembly is drawn by the primary airflow emitted from the mouth, amplifying the primary airflow. The nozzle includes a Coanda surface over which the mouth is arranged to direct the primary airflow. The Coanda surface extends symmetrically about the central axis of the opening so that the airflow generated by the fan assembly is in the form of an annular jet having a cylindrical or frusto-conical profile.

The user is able to change the direction in which the air flow is emitted from the nozzle in one of two ways. The base includes an oscillation mechanism which can be actuated to cause the nozzle and part of the base to oscillate about a vertical axis passing through the centre of the base so that that air flow generated by the fan assembly is swept about an arc of around 180°. The base also includes a tilting mechanism to allow the nozzle and an upper part of the base to be tilted relative to a lower part of the base by an angle of up to 10° to the horizontal.

SUMMARY OF THE DISCLOSURE

According a first aspect there is provided a nozzle for a fan assembly. The nozzle comprises an air inlet, a first air outlet for emitting an air flow and a second air outlet for emitting an air flow, the first air outlet being opposite the second air outlet, and the first and second air outlets being oriented in convergent directions, and a valve for controlling the first and second air outlets. The valve comprises one or more valve members that are moveable to simultaneously adjust the size of the first air outlet and inversely adjust the size of the second air outlet. The nozzle further comprises a third air outlet and a fourth air outlet, the third air outlet being opposite the fourth air outlet, the third and fourth air outlets being oriented in convergent directions, and the third air outlet and the fourth air outlet each being substantially perpendicular to each of the first and second air outlets. In other words, the third air outlet and the fourth air outlet are oriented such that a line bisecting the first and second air outlets is perpendicular to a line bisecting the third and fourth outlets. The first, second, third and fourth air outlets are discrete. In other words, the first, second, third and fourth air outlets are physically separated from one another The present invention provides a nozzle which is capable of receiving input of a single air flow, e.g. from a single air supply source, and manipulating the air flow such that the direction of the air flow emitted from the nozzle may be changed without the need to tilt the assembly to which the nozzle is attached. The first air outlet emits a first air flow and the second air outlet emits a second air flow. The total air flow emitted from the nozzle, which is a combination of the first air flow and the second air flow, remains constant, but through varying the proportion of the total air flow emitted through each of the first and second air outlets, the profile of the air flow emitted from the nozzle can be changed. Moreover, this arrangement also provides that the third and fourth outlets can emit at least a small portion of the air flow generated by the fan assembly in directions that are lateral to the air flows emitted from the first and second air outlets, with these lateral air flows then supporting the collision of the air flows emitted from the first and second air outlets, and providing an increase in the velocity of the resultant air flow generated by the nozzle.

Preferably, the air inlet is arranged to receive an incoming air flow into the nozzle body. The first air outlet then arranged to emit a first outgoing air flow, whilst the second air outlet is arranged to emit a second outgoing air flow, wherein the first outgoing air flow and the second outgoing air flow each comprise at least a portion of the incoming air flow.

Preferably, the valve is arranged such that a size of the first air outlet is at a maximum when the one or more valve members are in the first end position and at a minimum when the one or more valve members are in the second end position, whilst a size of the second air outlet is at a maximum when the one or more valve members are in the second end position and at a minimum when the one or more valve members are in the first end position. In other words, it is preferable that the valve member is arranged such that when in the first end position the first air outlet is maximally open (i.e. open to the maximum extent possible, such that the size of the first outlet is at a maximum) and the second air outlet is maximally occluded (i.e. occluded to the maximum extent possible, such that the size of the second outlet is at a minimum) and when in the second end position the first air outlet is maximally occluded and the second air outlet is maximally open.

When at a minimum the first and/or second air outlets may be fully occluded/closed; however, it is preferable that when at a minimum the first and/or second air outlets are at least open to a very small extent as doing so provides that any tolerances/inaccuracies arising during manufacture will not lead to small gaps that could induce additional noise (e.g. whistling) when air passes through.

Preferably, the valve is arranged such that movement of the one or more valve members simultaneously adjusts the size of the first air outlet and inversely adjusts the size of the second air outlet whilst keeping the aggregate/combined size of the first and second air outlets constant. The first air outlet and the second air outlet therefore together define an aggregate air outlet of the nozzle. The first air outlet and the second air outlet may be provided on a face of the nozzle, and are preferably oriented towards a central axis of the face of the nozzle. Preferably, the one or more valve members are moveable relative to a body or outer casing of the nozzle.

Preferably, the valve is arranged such that a size difference between the first air outlet and the second air outlet when the one or more valve members are in the first end position is greater than a size difference between the first air outlet and the second air outlet when the one or more valve members are in the second end position. The valve may then be arranged such that the size of the first air outlet when the one or more valve members are in the first end position is greater than the size of the second air outlet when the one or more valve members are in the second end position, and the size of the first air outlet when the one or more valve members are in the second end position is greater than the size of the second air outlet when the one or more valve members are in the first end position.

The nozzle may further comprise an internal air passageway extending between the air inlet and the first and second air outlets. Preferably, the nozzle comprises a single an internal air passageway extending between the air inlet and the first and second air outlets. The nozzle may then further comprise a first side channel/duct that extends from the internal air passageway to the third air outlet and a second side channel/duct that extends from the internal air passageway to the fourth air outlet.

The valve may be arranged such that the size of both the third and fourth outlets is dependent upon the position of one or more valve members. Preferably, the valve is arranged such that movement of the one or more valve members simultaneously adjusts the size of third and fourth outlets.

The valve may be arranged such that both the third and fourth air outlets are maximally open when the one or more valve members are in-between the first end position and the second position. The valve may then be further arranged such that both the third and fourth air outlets are maximally occluded when the one or more valve members are in either of the first end position and the second position.

Preferably, the valve is arranged such that both the third and fourth air outlets are maximally open when the size of the first air outlet is approximately equal to the size of the second air outlet. The valve may then be further arranged such that both the third and fourth air outlets are maximally occluded when the difference in size between the first air outlet and the second air outlet is at a maximum.

The first air outlet and the second air outlet may be provided on a face of the nozzle, and are preferably oriented towards a central axis of the face of the nozzle. The first air outlet and the second air outlet may be oriented towards a convergent point located on a central axis of the face of the nozzle.

The angle of the face of the nozzle relative to a base of the nozzle may be from 0 to 90 degrees, is more preferably from 0 to 45 degrees, and is yet more preferably from 20 to 40 degrees. Preferably, the angle of the face of the nozzle relative to the base of the nozzle is acute and the first air outlet is higher the second air outlet when the base of the nozzle is horizontal.

The valve may comprise a plurality of valve members that cooperate to adjust the size of the first air outlet relative to the size of the second air outlet while keeping the size of the aggregate air outlet of the nozzle constant. To do so, the plurality of valve members may be linked so that they move simultaneously.

Preferably, the valve comprises a single valve member that is arranged to be moveable between the first end position and the second end position. The valve member may be arranged to be moveable between the first end position in which a first portion of the valve member maximally occludes the second air outlet and the second end position in which a second portion of the valve member maximally occludes the first air outlet. The first air outlet may be defined by a first portion of a body of the nozzle and the first portion of the valve member and the second air outlet may be defined by a second portion of the body of the nozzle and the second portion of the valve member. The first portion of the valve member (i.e. that partially defines the first air outlet) may have a shape that corresponds with a shape of the opposing, first portion of the body of the nozzle. In particular, the first portion of the valve member may have a radius of curvature that is substantially equal to a radius of curvature of the opposing, first portion of the body of the nozzle. The second portion of the valve member (i.e. that partially defines the second air outlet) may have a shape that corresponds with a shape of the opposing, second portion of the body of the nozzle. In particular, the second portion of the valve member may have a radius of curvature that is substantially equal to a radius of curvature of the opposing, second portion of body of the nozzle.

Preferably, the valve member is arranged to be moveable translationally (i.e. without rotation), and preferably rectilinearly (i.e. in a straight line) relative to the face of the nozzle.

The valve member may be arranged such that a third portion of the valve member maximally occludes the third air outlet when in both the first end position and the second end position, and a fourth portion of the valve member maximally occludes the fourth air outlet when in both the first end position and the second end position. The valve member may then be further arranged such that the third portion of the valve member minimally occludes the third air outlet when in-between the first end position and the second position, and the fourth portion of the valve member minimally occludes the fourth air outlet when in-between the first end position and the second position.

Preferably, the valve member is arranged such that a third portion of the valve member minimally occludes the third air outlet when the size of the first air outlet is approximately equal to the size of the second air outlet, and a fourth portion of the valve member minimally occludes the fourth air outlet when the size of the first air outlet is approximately equal to the size of the second air outlet. The valve member may then be further arranged such that the third portion of the valve member maximally occludes the third air outlet when the difference in size between the first air outlet and the second air outlet is at a maximum, and the fourth portion of the valve member maximally occludes the fourth air outlet when the difference in size between the first air outlet and the second air outlet is at a maximum.

The body of the nozzle may define an opening at a face of the nozzle and the valve member may then be disposed within the nozzle body adjacent to the opening. The valve member may then comprise an outermost/uppermost surface at least a portion of which is exposed within the opening defined by the nozzle body. The first and second air outlets may then be diametrically opposed on the face of the nozzle, within the opening defined by the nozzle body, such that the outermost surface extends between the first and second air outlets. Preferably, the first and second air outlets are oriented to direct an emitted air flow over at least a portion of the outermost surface of the valve member. The outermost surface of the valve member then provides an external guide surface of the nozzle. The first and second air outlets may be arranged to direct the air flow emitted therefrom such that the air flow passes across at least a portion of the external guide surface. The first and second air outlets may be arranged to direct an air flow over a portion of the external guide surface that is adjacent to the respective air outlet. Preferably, the external guide surface is outward facing, i.e. faces away from the centre of the nozzle. The external guide surface may span an area between (i.e. an area that separates) the first and second air outlets. In other words, the external guide surface may extend across the distance that separates the first and second air outlets. For example, the first and second air outlets may be diametrically opposed on the face of the nozzle, and a portion of the outermost/uppermost surface of the valve member may then extend between the diametrically opposed first and second air outlets. Preferably, the outermost surface of the valve member is at least partially convex.

The first air outlet may then be defined by a first portion of an edge of the opening at the face of the nozzle and the first portion of the valve member that is adjacent to the first portion of the edge, and the second air outlet may be defined by a second portion of the edge of the opening at the face of the nozzle and the second portion of the valve member that is adjacent to the second portion of the edge.

The third and fourth portions of the valve member may each comprise a slot or aperture formed in the valve member and that is arranged to be disposed over/aligned with the corresponding air outlet when the valve member is in-between the first end position and the second position. The third and fourth portions of the valve member may then each be arranged such that the slot or aperture is displaced away from the corresponding air outlet when the valve member is in either of the first end position and the second end position.

Preferably, the third and fourth portions of the valve member each comprise a slot or aperture formed in the valve member and that is arranged to be disposed over/aligned with the corresponding air outlet when the size of the first air outlet is approximately equal to the size of the second air outlet. The third and fourth portions of the valve member may then each be arranged such that the slot or aperture is displaced away from the corresponding air outlet when the difference in size between the first air outlet and the second air outlet is at a maximum.

According to a second aspect there is provided a fan assembly comprising an impeller, a motor for rotating the impeller to generate an air flow, and a nozzle according to the first aspect that is arranged to receive the air flow. Preferably, the fan assembly comprises a base upon which the fan assembly is supported, and an angle of the face of the nozzle relative to the base of the fan assembly is fixed. The angle of the face of the nozzle relative to the base of the fan assembly may be from 0 to 90 degrees, is preferably from 0 to 45 degrees, and is more preferably from 20 to 35 degrees. Preferably, the angle of the face of the nozzle relative to the base of the fan assembly is acute such that the first air outlet is higher the second air outlet when the base of the fan assembly is horizontal.

DETAILED DESCRIPTION OF THE DISCLOSURE

Figure 2:
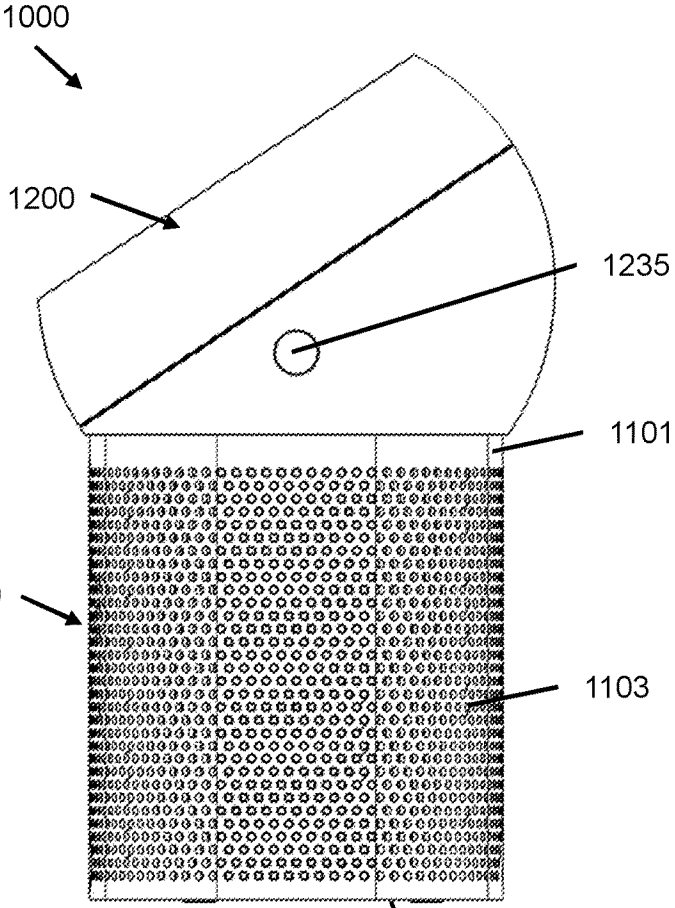
FIG. 2 shows a side view of the fan assembly of FIG. 1.

There will now be described a nozzle for a fan assembly which is capable of receiving input of a single air flow, e.g. from a single air supply source, and manipulating the air flow such that the direction of the air flow emitted from the nozzle may be changed without the need to tilt either the nozzle or the fan assembly to which the nozzle is attached. The term "fan assembly" as used herein refers to a fan assembly configured to generate and deliver an airflow for the purposes of thermal comfort and/or environmental or climate control. Such a fan assembly may be capable of generating one or more of a dehumidified airflow, a humidified airflow, a purified airflow, a filtered airflow, a cooled airflow, and a heated airflow. However, the fan assembly could equally be suitable for generating an airflow for other purposes, such as in a hair dryer or other hair care appliance.

The nozzle comprises an air inlet, a first air outlet for emitting an air flow and a second air outlet for emitting an air flow, the first air outlet being opposite the second air outlet, and the first and second air outlets being discrete (i.e. physically separated from one another) and oriented in convergent directions, and a valve for controlling the first and second air outlets. The valve comprises one or more valve members that are moveable to simultaneously adjust the size of the first air outlet and inversely adjust the size of the second air outlet. The nozzle further comprises a third air outlet and a fourth air outlet, the third air outlet being opposite the fourth air outlet, the third and fourth air outlets being discrete and oriented in convergent directions, and the third air outlet and the fourth air outlet each being substantially perpendicular to each of the first and second air outlets. In other words, the third air outlet and the fourth air outlet are oriented such that a line bisecting the first and second air outlets is perpendicular to a line bisecting the third and fourth outlets.

The term "air outlet" as used herein refers to a portion of the nozzle through which an air flow escapes from the nozzle. In particular, in the embodiments described herein, each air outlet comprises a conduit or duct that is defined by the nozzle and through which an air flow exits the nozzle. Each air outlet could therefore alternatively be referred to as an exhaust. This contrasts with other portions of the nozzle that are upstream from the air outlets and that serve to channel an air flow between an air inlet of the nozzle and an air outlet.

Through varying the size (i.e. the open area) of the first air outlet relative to the size of the second air outlet the proportion of the air flow that is emitted through each of the first and second air outlets also varies, thereby resulting in a change in the profile of the air flow generated by the nozzle. In particular, as the first and second air outlets are oriented in convergent directions, the first and second air flows will collide to form a single combined air flow that is directed away from the nozzle. The angle, or vector, at which the combined air flow is projected from the nozzle depends strongly on the relative strengths of the first and second air flows. Thus, by varying their individual strengths through moving the one or more valve members to adjust the size of the first air outlet relative to the second air outlet, it is possible to change the direction of the combined air flow. This arrangement means that the system sees constant load as the overall size of the aggregate air outlet remains constant. This means that the operating point of the compressor, or other means which supplies the air flow to the nozzle, also remains constant, as the air flow emitted from the nozzle can be controlled to vector back and forth. In addition, this allows for a reduction in the total system pressure that makes the system more energy efficient and quieter.

Moreover, this arrangement also provides that the third and fourth outlets can emit at least a small portion of the air flow generated by the fan assembly in directions that are lateral to the air flows emitted from the first and second air outlets, with these lateral air flows then supporting the collision of the air flows emitted from the first and second air outlets, and providing an increase in the velocity of the resultant air flow generated by the nozzle.

It is preferable that the nozzle comprises an external guide surface adjacent the air outlets. This external guide surface comprises an external surface of the fan assembly and may be flat or at least partially convex. The first and second air outlets can then each be oriented to direct an emitted air flow therefrom such that the air flow passes across over at least a portion of this external guide surface. Preferably, the first and second air outlets are oriented to emit an air flow in a direction that is substantially parallel to a portion of this external guide surface that is adjacent to the air outlet. It is then preferable that the external guide surface is shaped so that the external guide surface diverges or veers away from the direction in which the air flows are emitted from the first and second air outlets so that these air flows can collide at and/or around the convergent point without interference from the external guide surface. Emitting the air flows across the external guide surface minimises disruption of the air flows as they initially leave the nozzle, with the subsequent departure of the air flows from the external guide surface then allowing for the formation a separation bubble between the external guide surface, the emitted air flows and the convergent point. The formation of a separation bubble can assist in stabilising the resultant jet or combined air flow formed when the two opposing air flows collide.

Figure 1:
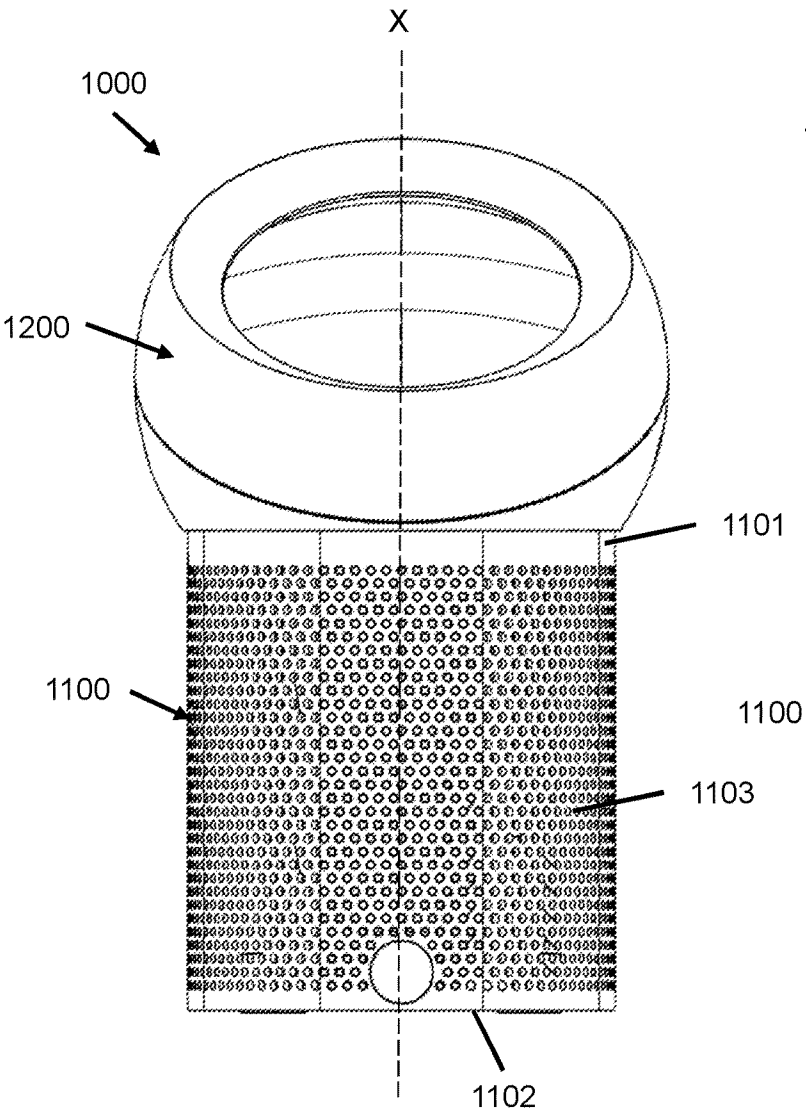
FIG. 1 shows a front view of an embodiment of a fan assembly.
Figure 4:
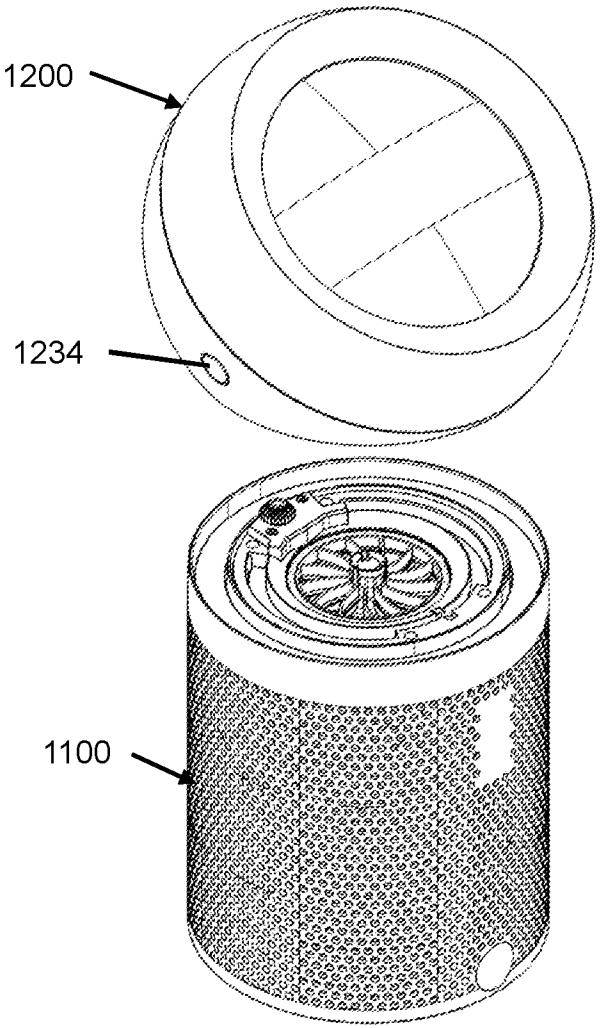
FIG. 4 shows an isometric view of the fan assembly of FIG. 1 with the nozzle of separated from the body.
Figure 3:
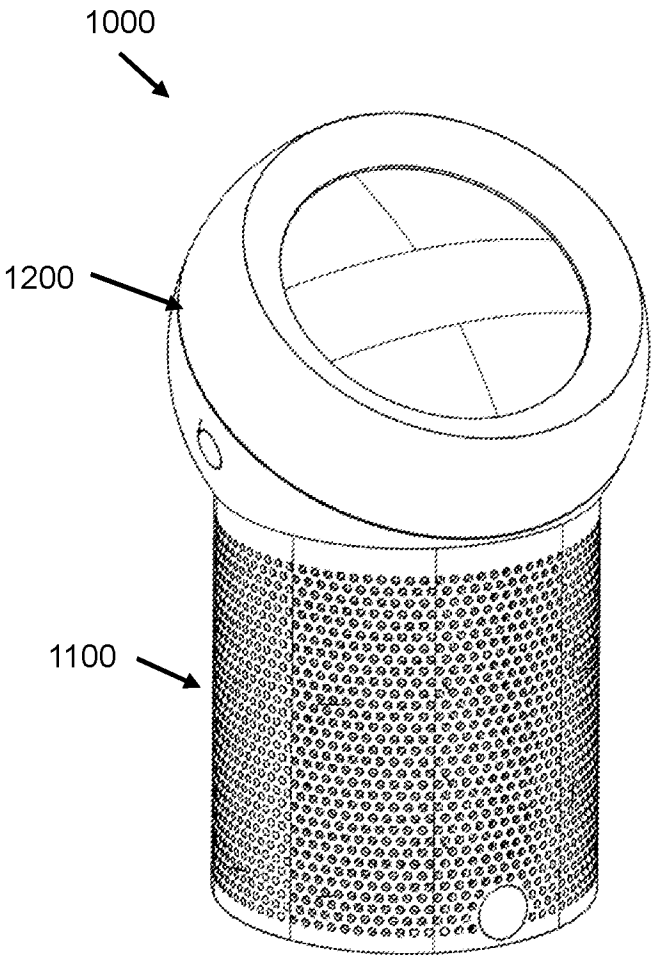
FIG. 3 shows an isometric view of the fan assembly of FIG. 1.

FIGS. 1, 2 and 3 are external views of an embodiment of a fan assembly 1000. FIG. 1 shows a front view of the fan assembly 1000, FIG. 2 shows a side view of the fan assembly 1000 and FIG. 3 shows an isometric view of the fan assembly 1000. The fan assembly 1000 comprises a body or stand 1100 containing a motor-driven impeller that is arranged to generate an airflow through the fan assembly and a nozzle 1200 releasably mounted on, and therefore detachable from, the body 1100, and which is arranged to emit the airflow from the fan assembly 1000. FIG. 4 therefore shows an isometric view of the fan assembly 1000 with the nozzle 1200 of separated from the body 1100.

Figure 5:
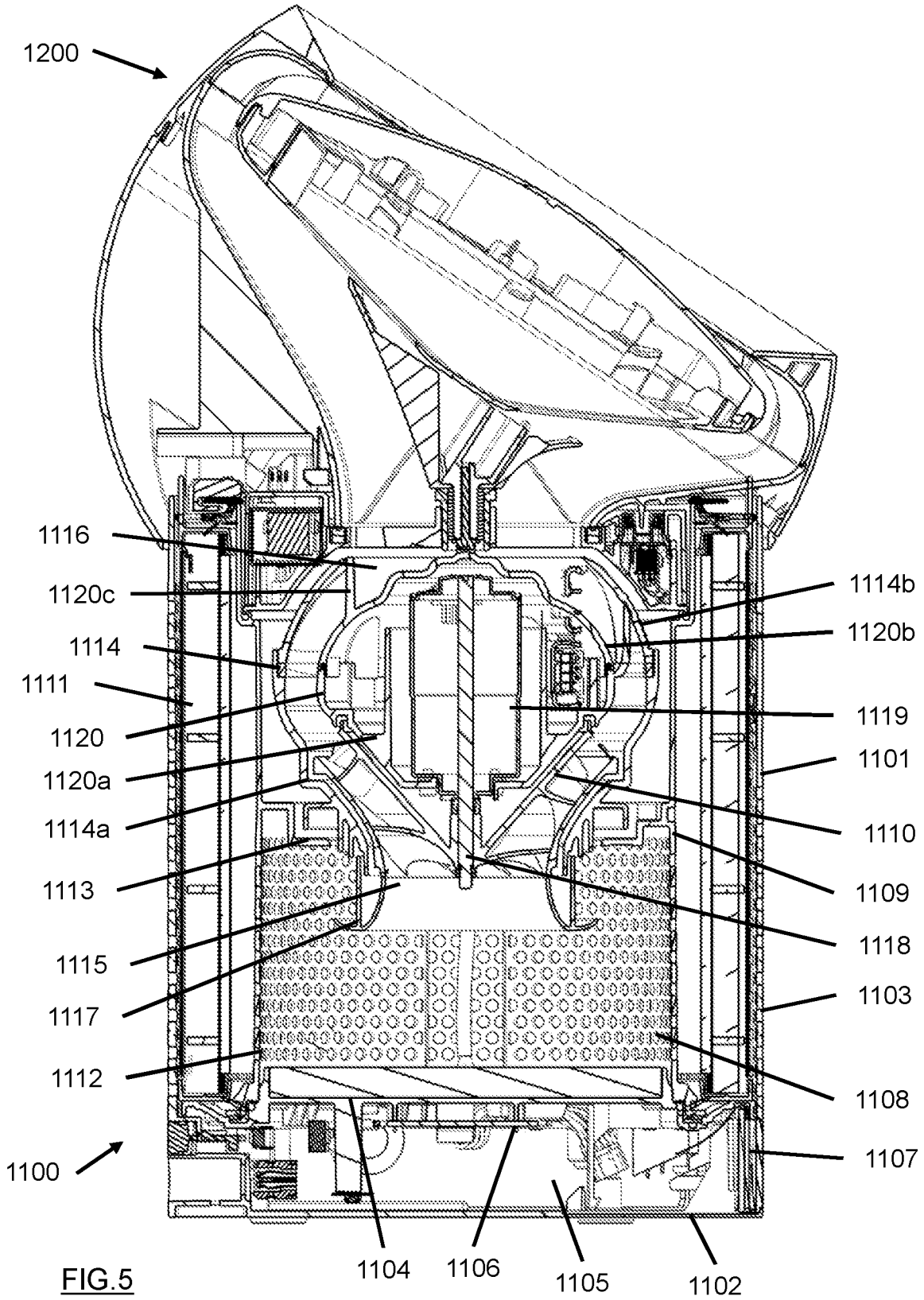
FIG. 5 illustrates a sectional side view through the fan assembly of FIG. 1.
Figure 6:
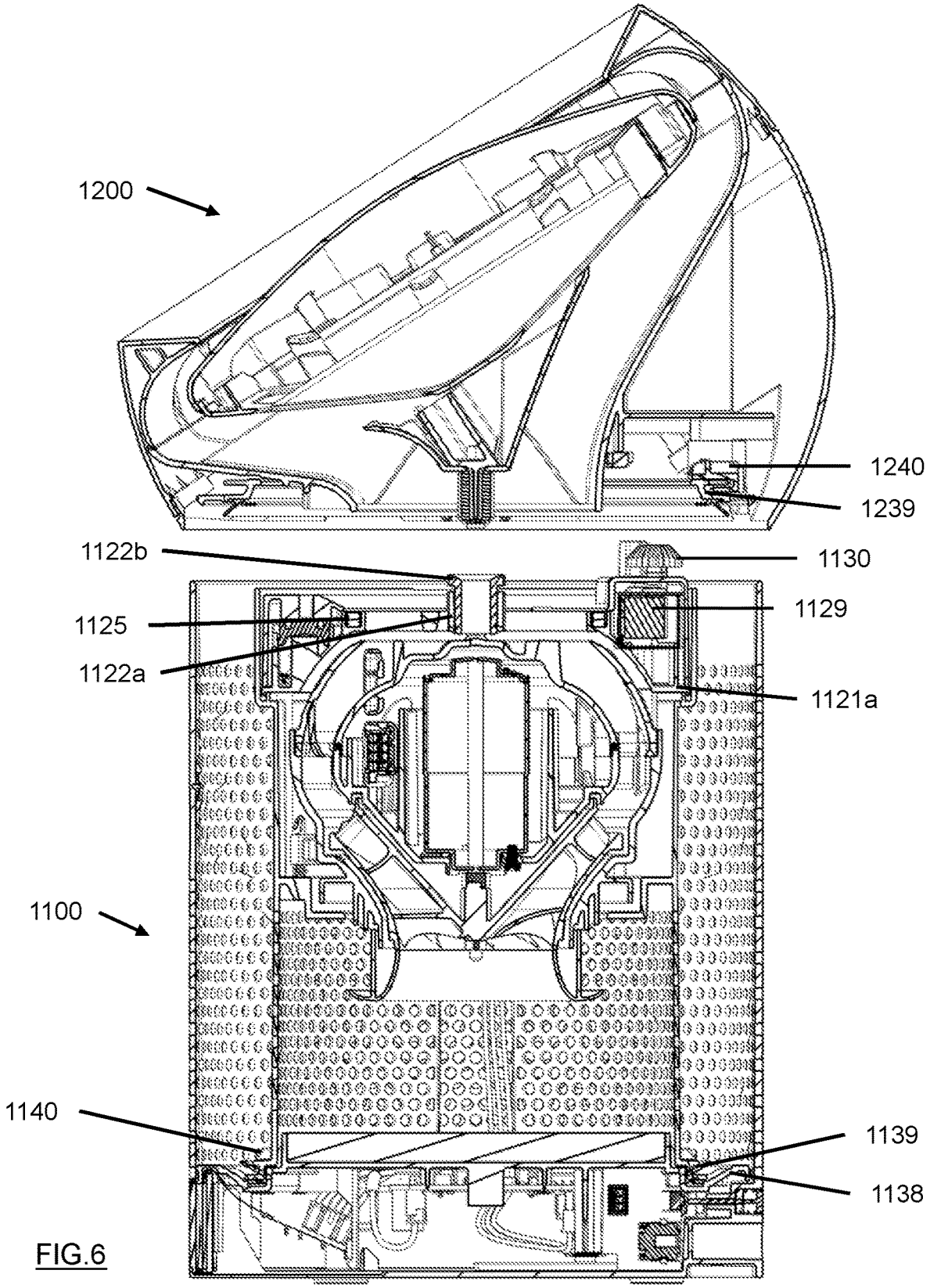
FIG. 6 illustrates a sectional view side through the fan assembly of FIG. 1 with the nozzle of separated from the body.
Figure 7:
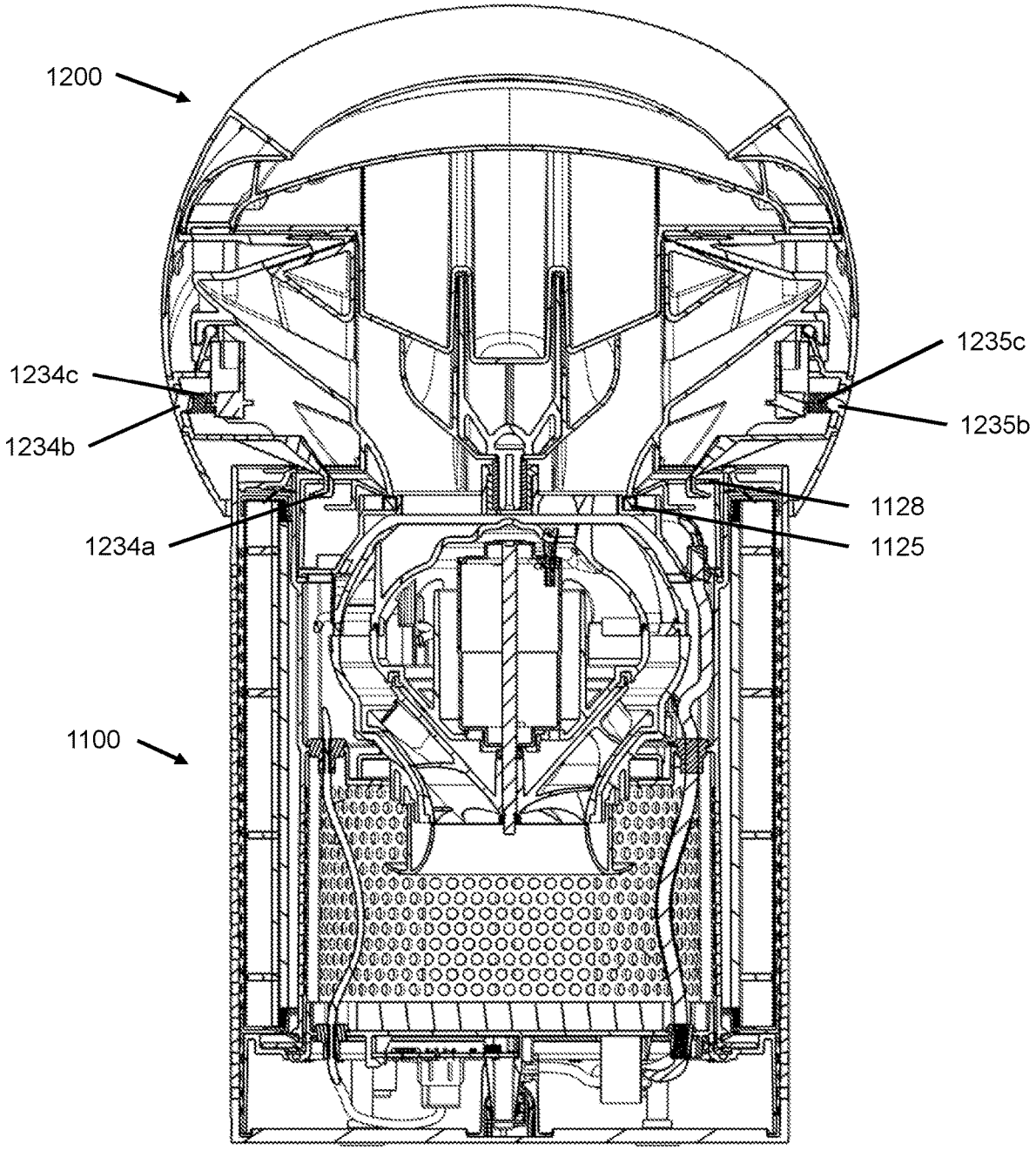
FIG. 7 illustrates a sectional front view through the fan assembly of FIG. 1.
Figure 8:
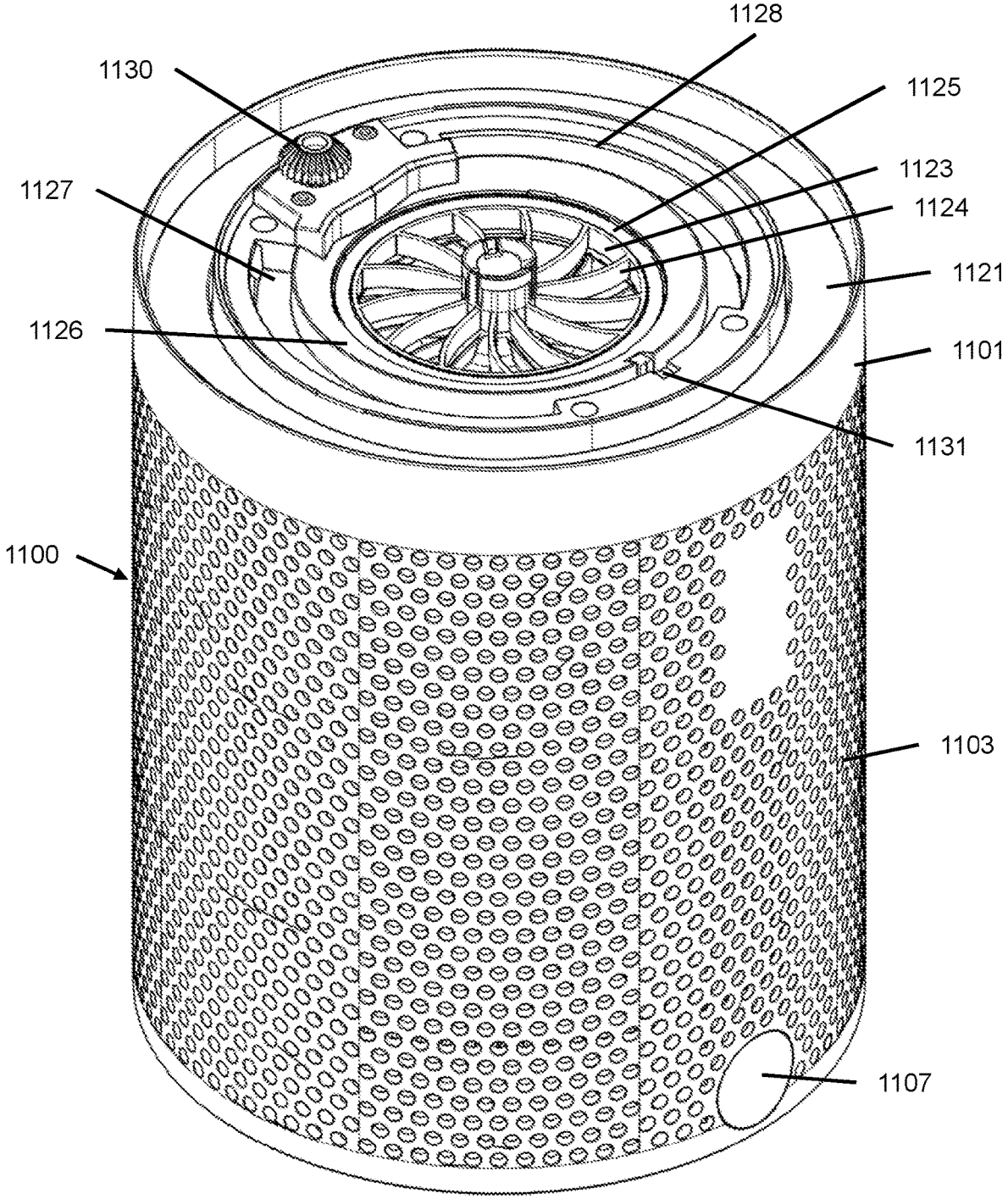
FIG. 8 then shows an isometric view of the body of the fan assembly of FIG. 1.

FIG. 5 illustrates a sectional side view through the fan assembly 1000, whilst FIG. 6 illustrates a sectional view side through the fan assembly 1000 with the nozzle 1200 of separated from the body 1100, and FIG. 7 illustrates a sectional front view through the fan assembly 1000. FIG. 8 then shows an isometric view of the body of fan assembly 1000. In the illustrated embodiment, the body 1100 comprises a cylindrical outer housing/casing 1101 having a side wall, a closed lower end and an open upper end, with the closed lower end thereby providing a base 1102 (i.e. lower surface) upon which the fan assembly 1000 rests/is supported and with an air inlet 1103 of the body 1100 being provided in the side wall of the outer casing 1101. In the illustrated embodiment, the air inlet 1103 into the body 1100 of the fan assembly 1000 comprises an array of apertures formed in the side wall of the outer casing 1101; however, the air inlets 1103 could alternatively comprise one or more grilles or meshes mounted within windows formed in the side wall.

The interior of the casing 1101 is then separated into lower sections and upper sections by a platform 1104 disposed within the casing 1101, at the lower end of the casing 1101. Specifically, the platform 1104 comprises a generally circular surface/floor that extends across the entire cross-sectional area of the interior of the casing 1101 and a generally cylindrical side wall that depends/projects downwardly from the surface and separates the surface from the lower end of the casing 1101. The raised surface of the platform 1104 thereby divides the interior of the outer casing 1101 into upper and lower sections, with the lower section comprising that portion of the casing 1101 interior that is beneath the surface and the upper section comprising that portion that is above the surface.

The lower section provides a compartment 1105 within which various electronic components of the fan assembly 1000 are housed, with the platform 1104 forming a cover that sits over and separates the electronics from the rest of the fan assembly. For example, these electronic components typically comprise the control circuit 1106, power supply connections, and one or more sensors, such as an infrared sensor, a dust sensor etc. In addition, the lower section of the body could also house one or more wireless communication modules, such as Wi-Fi, Bluetooth etc., and any associated electronics. The lower section may further comprise an electronic display 1107 that is visible through an opening or at least partially transparent window provided in the lower section. In the illustrated embodiment, the electronic display 1107 is provided by an LCD display that is mounted within the lower section and aligned with both a corresponding opening provided in the side wall of the platform 1104 and a transparent window provided in the side wall of the outer casing 1101.

The upper section then provides a separate compartment 1108 within which the various components of the fan assembly 100 that are involved in the generation of the air flow are housed, with the platform 1104 providing a base upon which these components can be supported. In the illustrated embodiment, an inner wall 1109 is provided within the upper section that is spaced apart from the inner surface of the side wall of the outer casing 1101. The inner wall 1109 thereby separates the upper section into an inner compartment within which the motor-driven impeller 1110 is housed and an outer compartment within which a filter assembly 1111 can be disposed. Specifically, the inner wall 1109 comprises an open ended cylinder that is supported on the upper surface of the platform 1104 provided at the lower end of the outer casing 1101 and thereby defines a generally cylindrical inner compartment which the motor-driven impeller 1110 is mounted. The inner wall 1109 is also smaller in diameter than the cylindrical outer casing 1101, and is disposed concentrically within the outer casing 1101, such that the outer compartment defined between the outer casing 1101 and the inner wall 1109 is annular and surrounds the periphery of the inner compartment. FIG. 6 illustrates a sectional view side through the fan assembly 1000 in which the filter assembly 1111 has been removed from the fan body 1100 to clearly show the outer compartment defined between the outer casing 1101 and the inner wall 1109 of the fan body 1100.

A lower portion of the inner wall 1109 is provided with an array of apertures 1112 that allow air to flow into the inner compartment and thereby provide an air inlet into the inner compartment. A ledge/shelf 1113 then extends radially inwardly from the inner wall 1109 above the array of apertures 1112 with the motor-driven impeller 1110 then being supported by the shelf 1113 within an upper portion of the inner compartment. In the illustrated embodiment, the inner compartment contains an impeller housing 1114 that extends around the impeller 1110 and that has a first end defining an air inlet 1115 of the impeller housing 1114 and a second end located opposite to the first end and defining an air outlet 1116 of the impeller housing 1114. The impeller housing 1114 is aligned within the inner compartment/outer casing 1101 such that the longitudinal axis of the impeller housing 1114 is collinear with the longitudinal axis (X) of the body 1100 of the fan assembly 100 and so that the air inlet 1115 of the impeller housing 1114 is located beneath the air outlet 1116. The impeller housing 1114 comprises a generally frusto-conical lower wall 1114*a* and a generally frusto-conical upper wall 1114*b*. A substantially annular inlet member 1117 is then connected to the bottom of the lower wall 1114*b* of the impeller housing 1114 for guiding the incoming airflow into the impeller housing 1114. The air inlet 1115 of the impeller housing 1114 is therefore defined by the annular inlet member 1117 provided at the open bottom end of the impeller housing 1114.

In the illustrated embodiment, the impeller 1110 is in the form of a mixed flow impeller and comprises a generally conical hub, a plurality of impeller blades connected to the hub, and a generally frusto-conical shroud connected to the blades so as to surround the hub and the blades. The impeller 1110 is connected to a rotary shaft 1118 extending outwardly from a motor 1119 that is housed within a motor housing 1120 disposed within the impeller housing 1114. In the illustrated embodiment, the motor 1119 is a DC brushless motor having a speed which is variable by the control circuit 1106 in response to control inputs provided by a user.

The motor housing 1120 comprises a generally frusto-conical lower portion 1120*a* that supports the motor 1119, and a generally frusto-conical upper portion 1120*b* that is connected to the lower portion 1120*a*. The shaft 1118 protrudes through an aperture formed in the lower portion 1120*a* of the motor housing 1120 to allow the impeller 1110 to be connected to the shaft 1118. The upper portion 1120*b* of the motor housing 1120 further comprises an annular diffuser 1120*c* in the form of curved blades that project from the outer surface of the upper portion 1120*b* of the motor housing 1120. The walls of the impeller housing 1114 surround and are spaced from the motor housing 1120 such that the impeller housing 1114 and the motor housing 1120 between them define an annular air flow path which extends through the impeller housing 1114. The air outlet 1116 of the impeller housing 1114, through which the airflow generated by the motor-driven impeller 1110 is exhausted, is then defined by the upper portion 1120*b* of the motor housing 1120 and the upper wall 1114*b* of the impeller housing 1114.

A nozzle seat/mount platform 1121 is then disposed within the upper end of the inner compartment above the impeller housing 1114. The nozzle seat 1121 has a circular cross-section and comprises a lower portion 1121*a* connected to an upper portion 1121*b*, with the lower portion 1121*a* fitting around the upper wall 1114*b* of the impeller housing 1114. The centre of the nozzle seat 1121 comprises a bearing 1122 that forms part of a plain/journal bearing assembly that will be described in more detail below. In the illustrated embodiment, the bearing 1122 comprises a hollow cylinder 1122*a* housing a self-lubricating bushing or sleeve bearing 1122*b*. For example, such a self-lubricating bushing can comprise an at least partially porous tubular member that is impregnated with a lubricant, and preferably has a lubricant content from 12 to 20%. At the upper open end of the bushing 1122*b*, the inner edge is chamfered to provide a surface that slopes radially inward towards the hollow interior of the bushing 1122*b*.

The nozzle seat 1121 then further comprises an annular air vent/opening 1123 that surrounds the centre bearing 1122 and that is aligned with the air outlet 1116 of the impeller housing 1114 such that the airflow exhausted from the impeller housing 1114 exits the body 1100 of the fan assembly 1000 through the annular air vent 1123 of the nozzle seat 1121. Specifically, the annular air vent 1123 of the nozzle seat 1121 is defined by a plurality of curved blades 1124 that project from the outer surface of the centre bearing 1122 and that connect the centre bearing 1122 to an outer annular portion of the nozzle seat 1121. The curved blades 1124 of the nozzle seat 1121 are preferably aligned with the curved blades of the annular diffuser 1120*c* provided at the outlet 1116 of the impeller housing 1114.

The nozzle seat 1121 then further comprises a body outlet sealing member 1125 disposed around the periphery of the annular vent 1123 that contacts and forms a seal against a bottom portion of the nozzle 1200 when the nozzle 1200 is mounted on the body 1100 of the fan assembly 1000 to prevent leakage of air at the interface between the air outlet 1123 of the body 1100 and an air inlet of the nozzle 1200. In the illustrated embodiment, the outlet sealing member 1125 is annular and is retained within a corresponding groove or slot provided in the nozzle seat 1121, and may conveniently be formed from a resilient material such as a rubber. The nozzle seat 1121 then further comprises an annular nozzle alignment surface 1126 disposed around the periphery of the outlet sealing member 1125 that is sloped downwardly towards the outlet sealing member 1125 and that is therefore arranged to assist with guiding an air inlet of the nozzle 1200 into alignment with the air outlet 1123 of the body 1100.

The nozzle seat 1121 then further comprises a circular arcuate recess 1127 that surrounds the majority of the annular air vent 1123 and that is disposed around outside the periphery of the nozzle alignment surface 1126 and therefore radially outward relative to the annular vent 1123 and the outlet sealing member 1126. An outer wall of the accurate recess 1127 is provided with a ledge/lip 1128 that projects radially inward so as to partially overhang the accurate recess.

The nozzle seat 1121 further comprises the drive portion of an oscillation mechanism for oscillating at least a portion of the nozzle 1200 relative to the fan body 1100, wherein the drive portion comprises an oscillation motor 1129 and a drive member 1130 that is arranged to be driven by the oscillation motor 1129. In the illustrated embodiment, the oscillation motor 1129 is disposed within/beneath a raised portion of the nozzle seat 1121, which is located between the two ends of the accurate recess 1127, with a shaft of the oscillation motor 1129 protruding through an aperture in the raised portion of the nozzle seat 1121. The drive member is then provided by a pinion 1130 that is mounted on the protruding portion of the shaft, above the raised portion of the nozzle seat 1121. The pinion 1130 is therefore located above the uppermost surface of the nozzle seat 1121.

Figure 9:
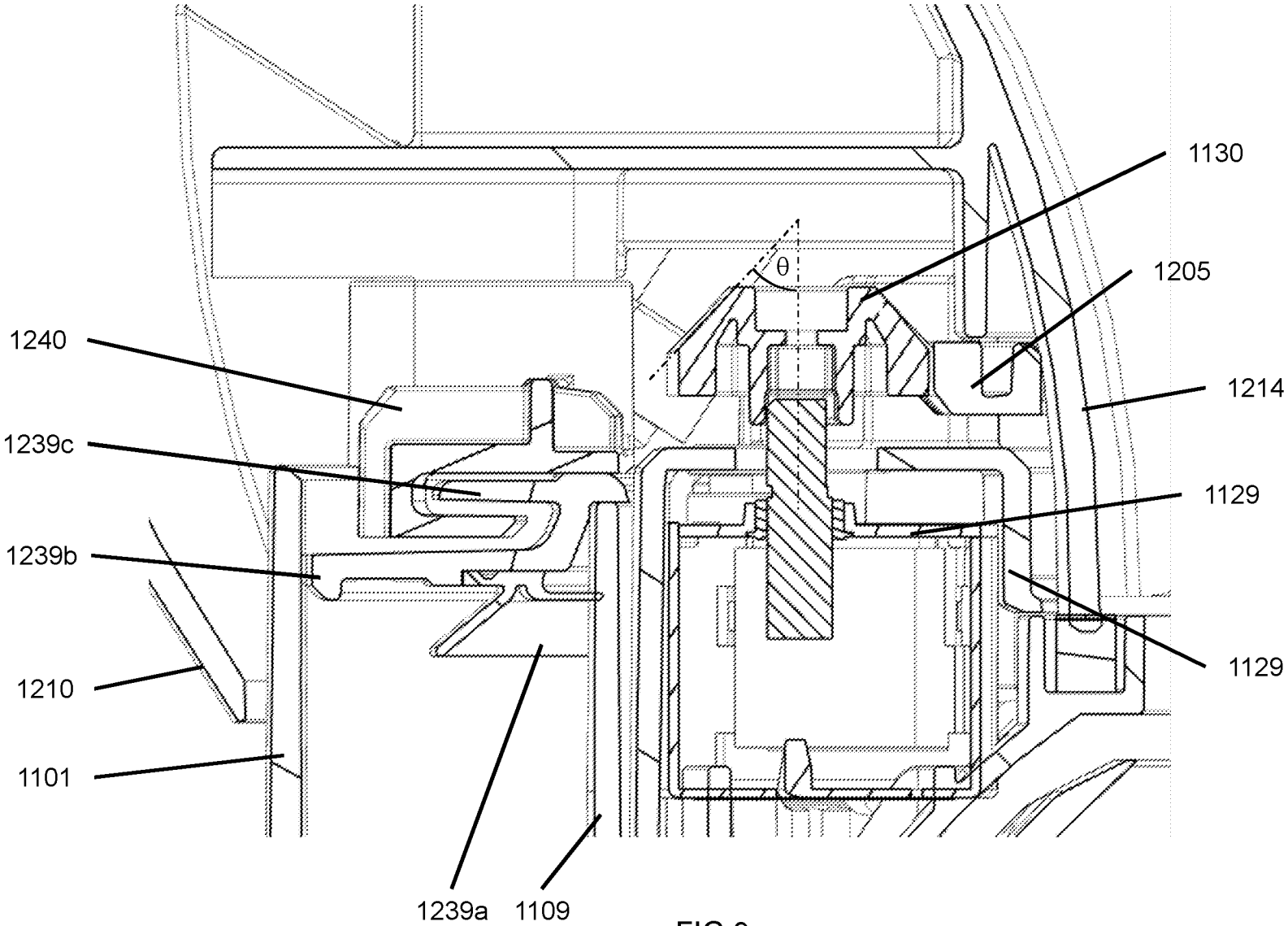
FIG. 9 illustrates an enlarged sectional view through the fan assembly of FIG. 1 showing the oscillation mechanism.

FIG. 9 illustrates an enlarged sectional view through the fan assembly 1000 showing the oscillation mechanism. In this embodiment, the pinion 1130 comprises a spur gear having radially projecting teeth that are straight and aligned parallel to the axis of rotation but in which the upper portion of the gear is chamfered. Specifically, both the root and teeth of the upper portion of the gear are chamfered, with the root angle (θ) of the chamfered portion preferably being approximately 45 degrees. In other words, the pinion 1130 comprises a straight gear having a cylindrical lower portion and a conical/frusto-conical upper portion, such that the upper portion has the form of a straight bevel gear.

In addition, the nozzle seat 1121 further comprises a photo-interrupter 1131 as part of a mechanism for detecting the orientation of the nozzle 1200 when mounted on the body 1100. In this regard, a photo-interrupter is photo-sensor that comprises light emitting elements and light receiving elements that are aligned facing each other across a gap defined between them. The photo-interrupter then works by detecting when a target object comes between both elements and prevents light from the emitting elements from reaching the receiving elements. Typically, an infrared emitter is usually used as the light emitting element while an infrared detector is employed as the receiving element. In the illustrated embodiment, the photo-interrupter 1131 is disposed such that the gap between the light emitting elements and the light receiving elements is aligned with the arcuate recess 1127, and with the light emitting elements on one side of the gap and the light receiving elements on the other side, at approximately the mid-point of the arcuate recess 1127.

As mentioned above, the outer compartment of the upper section of the body 1100 provides a space into which a filter assembly 1111 can be disposed such that the filter assembly 1111 is then downstream of the air inlet 1103 of the body 1100 and upstream of the motor-driven impeller 1110. Consequently, air drawn into the interior of the body 1100 by the impeller 1110 is filtered prior to passing through the impeller 1110. This serves to remove any particles which could potentially cause damage to the fan assembly 1000, and also ensures that the air emitted from the nozzle 1200 is free from particulates. In addition, the filter assembly 1100 preferably further comprises at least one chemical filter media that serves to remove various chemical substances from the air flow that could potentially be a health hazard so that the air emitted from the nozzle is purified.

Figure 10:
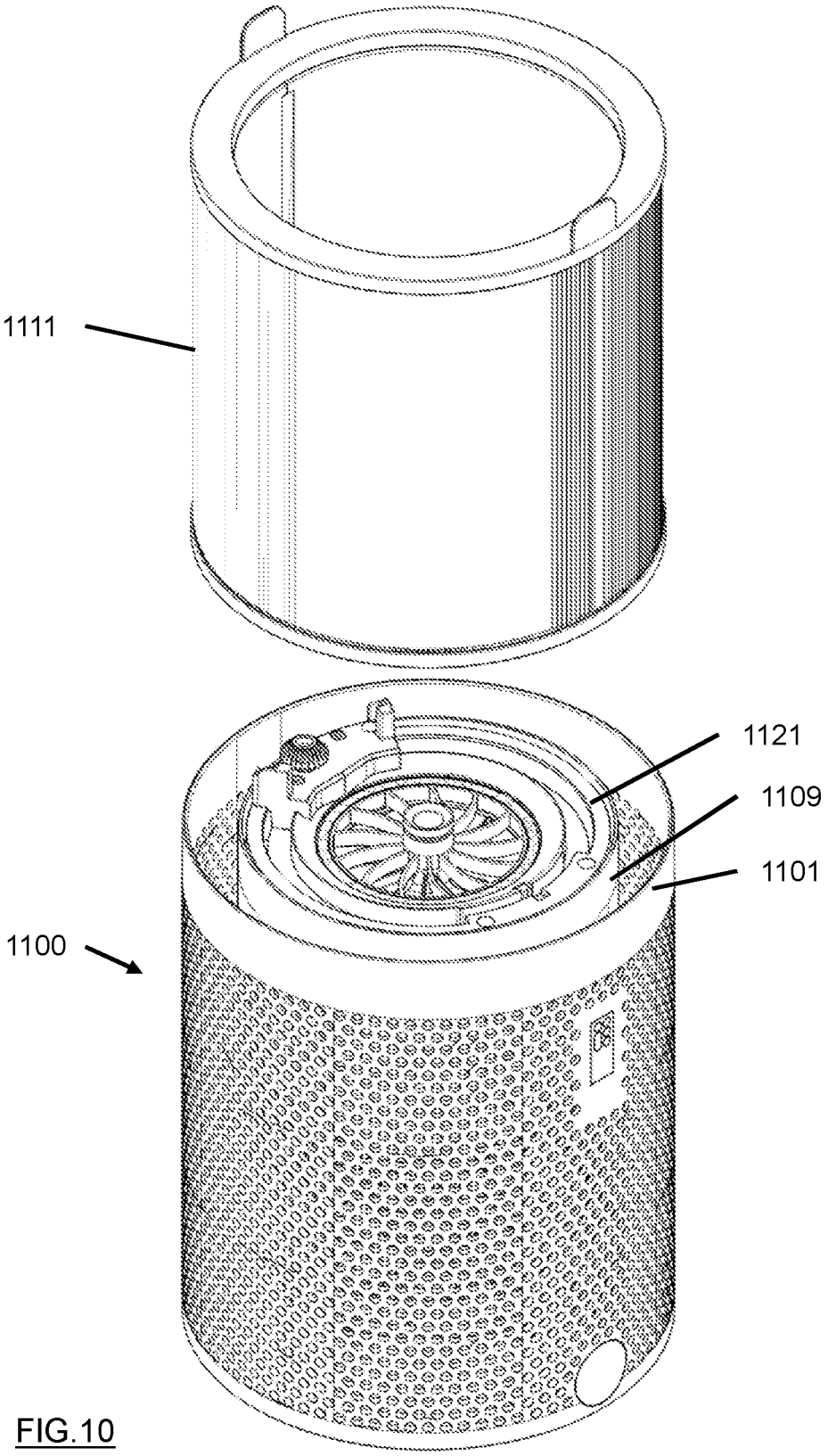
FIG. 10 shows an isometric view of the body of the fan assembly of FIG. 1 with the filter assembly removed from the body.

FIG. 10 shows an isometric view of the body 1100 of the fan assembly 1000 with the filter assembly 1111 removed from the body 1100. In the illustrated embodiment, the annular outer compartment defined by the inner wall 1109 surrounds the periphery of the inner compartment and has an open upper end that allows the filter assembly 1111 to be inserted into and removed from the outer compartment. The filter assembly 1111 therefore has the shape of a hollow cylinder that is arranged to fit concentrically over the inner wall 1109 within the annular outer compartment such that filter assembly 1111 surrounds the entire periphery of the inner wall 1109. Specifically, the filter assembly 1111 comprises one or more filter media 1132, 1133 formed into a hollow cylindrical shape with the two opposing ends of the one or more filter media then each being covered by a filter end cap 1135, 1136.

Figure 11:
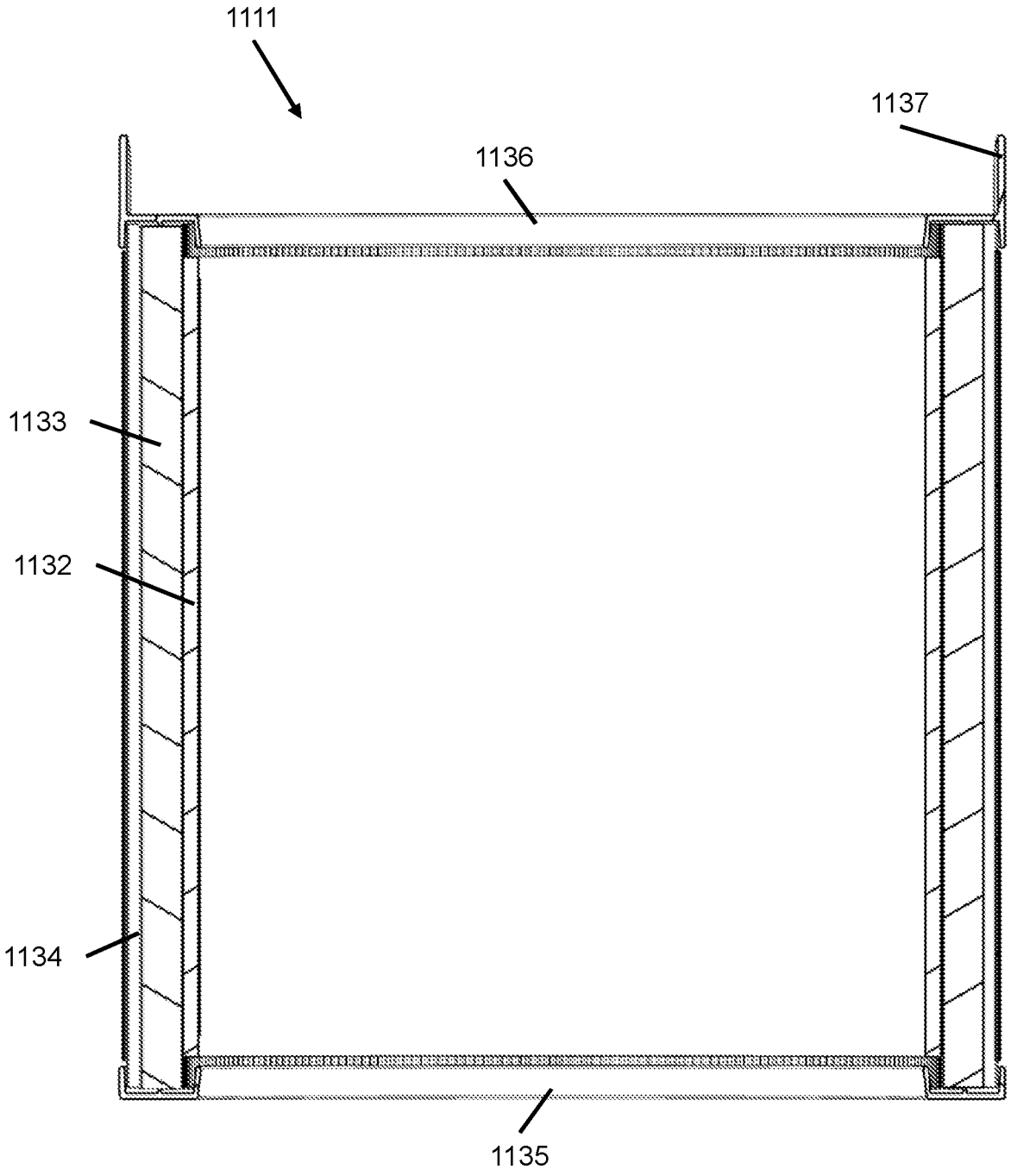
FIG. 11 shows a sectional view side through a filter assembly suitable for use with the fan assembly described herein.

FIG. 11 shows a sectional view side through a filter assembly 1111 suitable for use with the fan assembly 1000 described herein. In the illustrated embodiment, the filter assembly 1111 comprises a chemical filter media layer 1132, a particulate filter media layer 1133 disposed over the outer face of the chemical filter media layer 1132 and therefore upstream of the chemical filter media layer 1132, and an outer mesh layer 1134 disposed over the outer face of the particulate filter media layer 1133 and therefore upstream of the particulate filter media layer 1133. A first end cap 1135 is then disposed over a first end of each of the particulate filter media layer 1133, the chemical filter media layer 1132 and the outer mesh layer 1134, whilst a second end cap 1136 is disposed over a second end of each of the particulate filter media layer 1133, the chemical filter media layer 1132 and the outer mesh layer 1134. For example, the particulate filter media 1133 could comprise a pleated polytetrafluoroethylene (PTFE) or glass microfiber nonwoven fabric, whilst the chemical filter media 1132 could comprise an activated carbon filter media such as a carbon cloth. The filter end caps 1135, 1136 could then be moulded from a plastic material and attached/adhered to the ends of the filter media using an adhesive. In a preferred embodiment, one of the filter end caps 11336 further comprises one or more tabs 1137 that project longitudinally away from the filter end cap 1136 and that can therefore be gripped by a user to assist in lifting the filter assembly 1111 out of the annular outer compartment.

The portion of the surface of the platform 1104 that extends beyond the inner wall 1109 of the upper section to the inner surface of the outer casing 1101 then provides a filter seat 1138 upon which the filter assembly 1118 can be supported. A lower filter sealing element 1139 is then provided around the periphery of a lower end of the inner wall 1109, with this lower end of the inner wall 1109 being received within a recess formed in the upper surface of the platform 1104. The lower filter sealing element 1139 therefore contacts and forms a seal against a bottom end cap 1135 of the filter assembly 1111 when the filter assembly 1111 is supported on the filter seat 1138 to prevent leakage of air around the bottom of the filter assembly 1111. In the illustrated embodiment, the lower filter sealing element 1139 is annular and may conveniently be formed from a rubber material. The inner wall 1109 of the upper section is then also provided with a plurality of ribs/segments 1140 that project radially outward from the lower end of the inner wall 1109, above the lower filter sealing element 1139, with each of these projecting segments 1140 having an outer face that tapers/slopes to assist with aligning the filter assembly 1111 concentrically around the inner wall 1109.

When the filter assembly 1111 is disposed within the outer compartment of the body 1100, air drawn into the body 1100 by the impeller 1110 first passes through the air inlet 1103 of the body 1100 that is provided by the apertures in the side wall of the outer casing 1101 before passing through the filter assembly 1111. This filtered air is then drawn through the air inlet 1112 of the inner compartment that is provided by the apertures provided in the lower portion of the inner wall 1109 before entering the annular air flow path of the impeller housing 1114 through the air inlet 1115 provided at the bottom of the impeller housing 1114. The air then exits the impeller housing 1114 through the air outlet 1116 provided at the top of the impeller housing 1114 before being exhausted from the body 1100 of the fan assembly 1000 through the air vent 1123 provided by the nozzle seat 1121.

Figure 12:
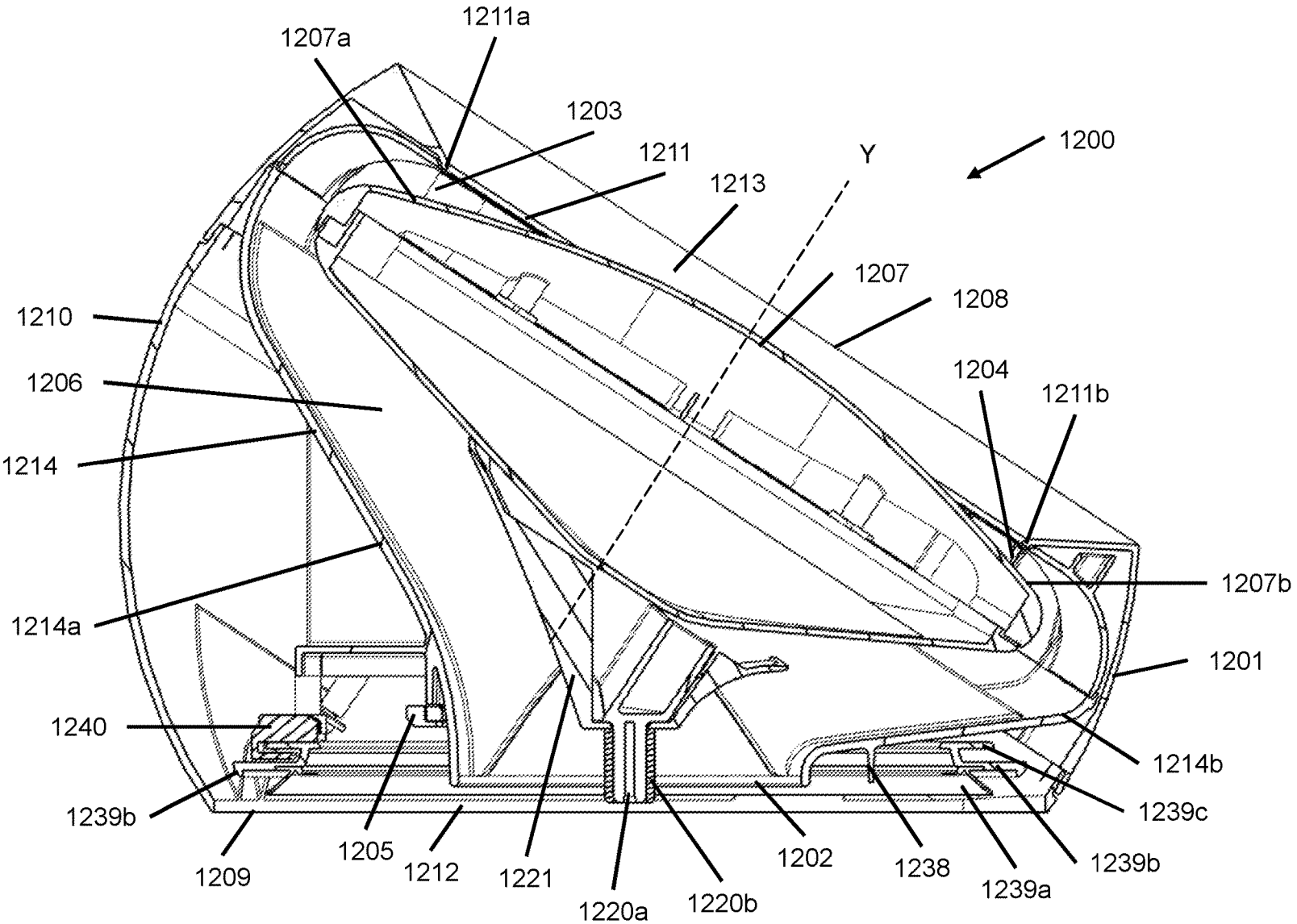
FIG. 12 shows a sectional side view of the nozzle of the fan assembly of FIG. 1.
Figure 13:
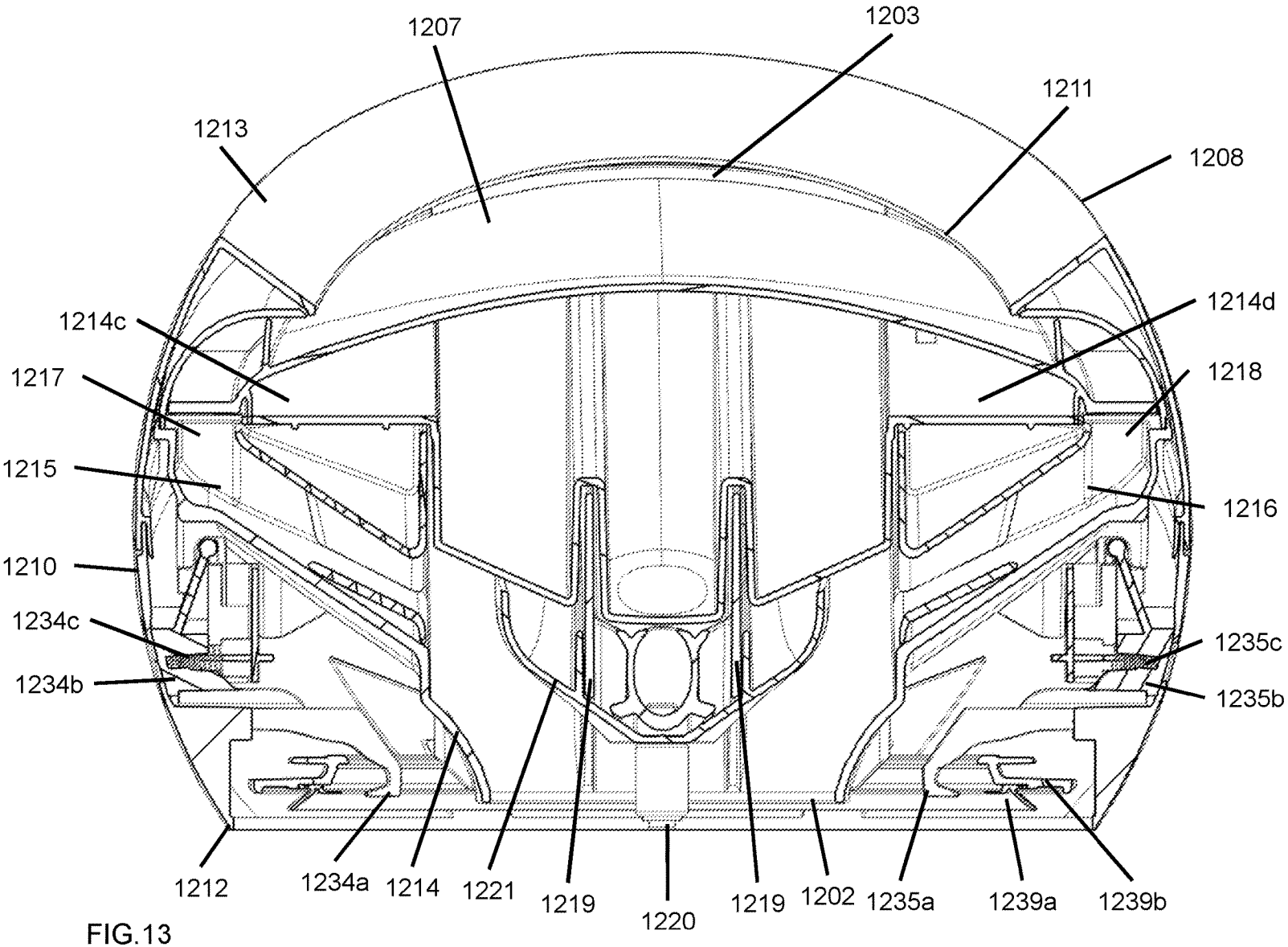
FIG. 13 shows a sectional front view of the nozzle of the fan assembly of FIG. 1.
Figure 14:
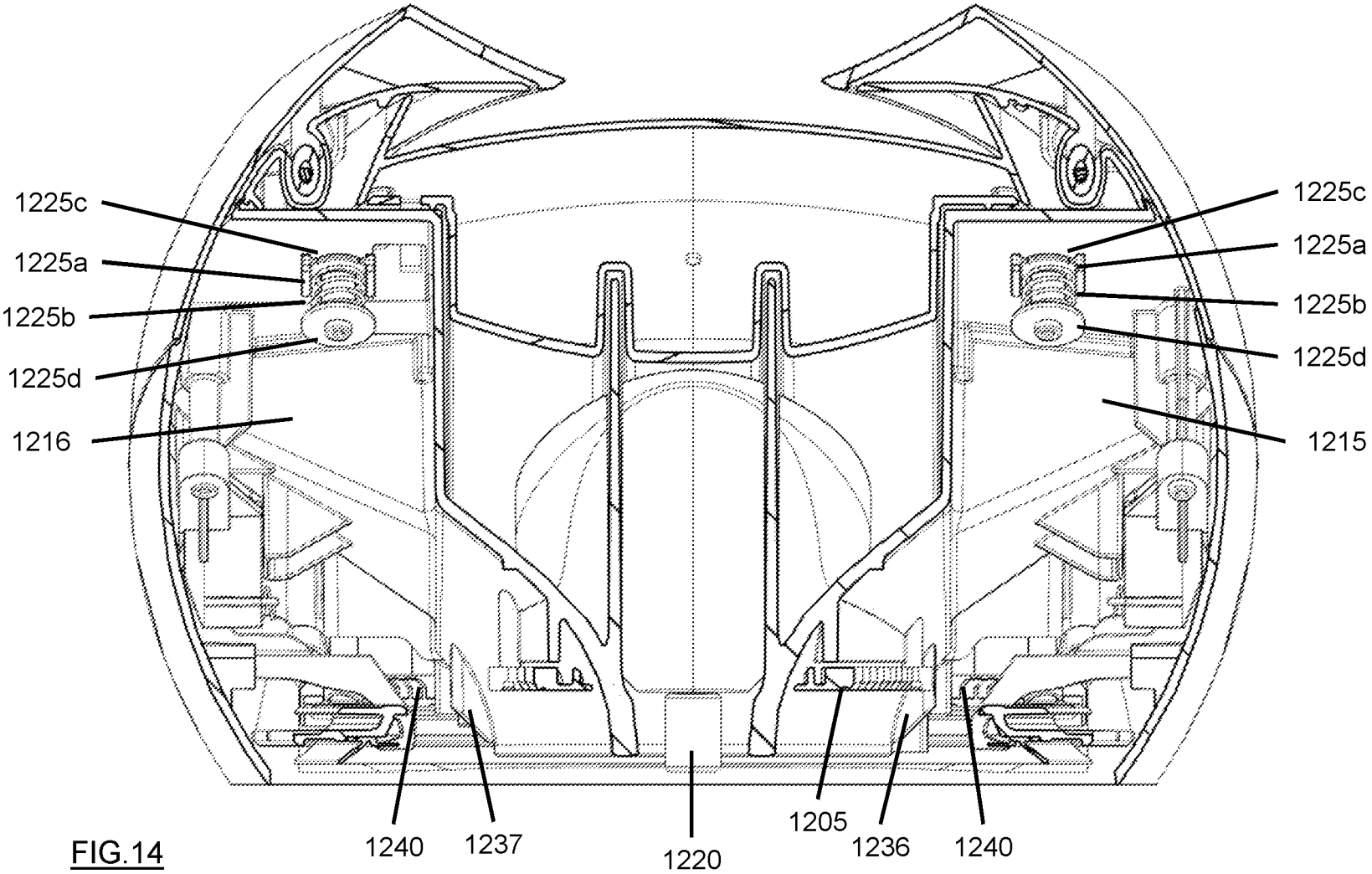
FIG. 14 shows a sectional rear view of the nozzle of the fan assembly of FIG. 1.
Figure 15:
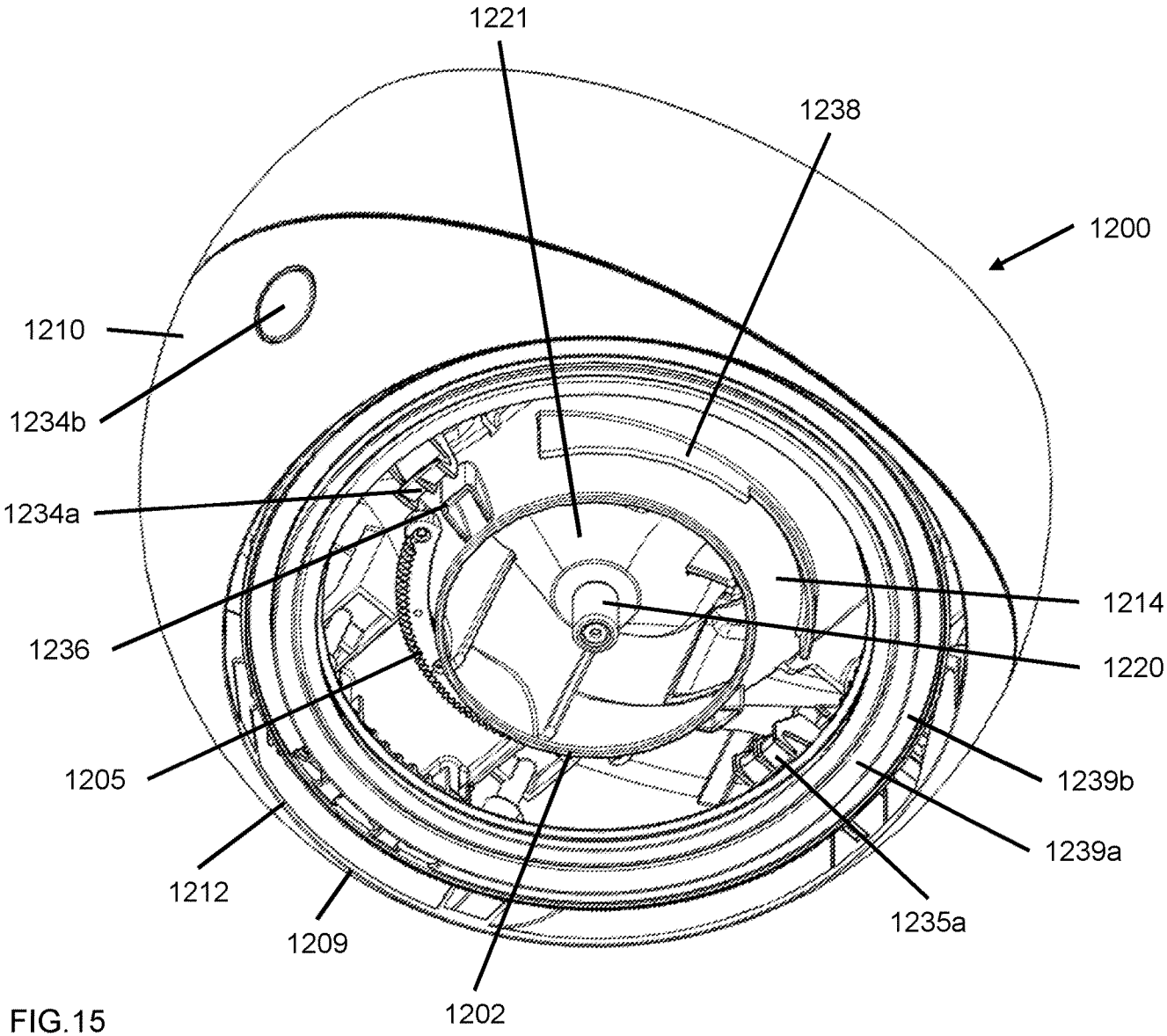
FIG. 15 shows an isometric view of the lower end of the nozzle of the fan assembly of FIG. 1.

As described above, and as shown in FIGS. 4 and 6, the nozzle 1200 is arranged to be releasably attached to the fan body 1100. FIGS. 12 to 15 therefore show an embodiment of a nozzle 1200 that can be releasably attached to the fan body 1100 described above. FIG. 12 shows a sectional side view of the nozzle 1200, FIG. 13 shows a sectional front view of the nozzle 1200, FIG. 14 shows a sectional rear view of the nozzle 1200, and FIG. 15 shows an isometric view of the lower end of the nozzle 1200. The nozzle 1200 comprises a nozzle body 1201 that at least partially defines an air inlet 1202 that is arranged to receive the airflow from the fan body 1100, a first flow vectoring air outlet 1203 for emitting an air flow from the nozzle 1200 and a second flow vectoring air outlet 1204 for emitting an air flow from the nozzle 1200. The nozzle 1200 further comprises both a nozzle retaining mechanism for releasably retaining the nozzle 1200 on the fan body 1100 and the driven portion of the oscillation mechanism, wherein the driven portion comprises a driven member 1205 that is arranged to be driven by the drive member 1130 to rotate the nozzle body 1201 around an oscillation axis (X).

The first and second flow vectoring air outlets 1203, 1204 are oriented in convergent directions, such that the emitted air flows converge. In other words, the first and second flow vectoring air outlets 1203, 1204 are oriented such that a first outgoing airflow emitted from the first flow vectoring air outlet 1203 will collide with a second outgoing airflow emitted from the second flow vectoring air outlet 1204. The nozzle 1200 further comprises an internal air passageway 1206 extending between the air inlet 1202 and both the first and second flow vectoring air outlets 1203, 1204. The first outgoing airflow emitted from the first flow vectoring air outlet 1203 and the second outgoing airflow emitted from the second flow vectoring air outlet 1204 will therefore each comprise at least a portion of an incoming air flow that enters the nozzle 1200 through the air inlet 1202. The nozzle 1200 then further comprises a valve for controlling the flow of air from the air inlet 1202 to the first and second flow vectoring air outlets 1203, 1204, with the valve comprising a valve member 1207 that is moveable relative to the nozzle body 1201 to simultaneously adjust the size of the first flow vectoring air outlet 1203 and inversely adjust the size of the second flow vectoring air outlet 1204.

Through varying the size (i.e. the open area) of the first flow vectoring air outlet 1203 relative to the size of the second flow vectoring air outlet 1204 the proportion of the air flow that is emitted through each of the first and second flow vectoring air outlets 1203, 1204 also varies, thereby resulting in a change in the profile of the air flow generated by the nozzle 1200. In particular, as the first and second flow vectoring air outlets 1203, 1204 are oriented in convergent directions, the air flows emitted from the first and second flow vectoring air outlets 1203, 1204 will collide to form a single combined air flow that is directed away from the nozzle 1200. The angle, or vector, at which the combined air flow is projected from the nozzle 1200 depends strongly on the relative strengths of these first and second air flows. Thus, by varying their individual strengths through moving the valve member 1207 to adjust the size of the first flow vectoring air outlet 1203 relative to the second flow vectoring air outlet 1204, it is possible to change the direction of the combined air flow. This arrangement means that the system sees constant load as the overall size of the aggregate air outlet remains constant. This means that the operating point of the compressor, or other means which supplies the air flow to the nozzle 1200, also remains constant, as the air flow emitted from the nozzle 1200 can be controlled to vector back and forth. In addition, this allows for a reduction in the total system pressure that makes the system more energy efficient and quieter.

In the illustrated embodiment, the nozzle body 1201 has the general shape of a truncated sphere, with a first truncation forming a circular face 1208 of the nozzle 1200 and a second truncation forming a circular base 1209 of the nozzle 1200. The air inlet 1202 of the nozzle 1200 is provided at the base 1209 of the nozzle 1200, whilst the first flow vectoring air outlet 1203 and the second flow vectoring air outlet 1204 are diametrically opposed on the face 1208 of the nozzle 1200 and are generally oriented towards a central axis (Y) of the face 1208 of the nozzle 1200. The angle ($\alpha$) of the face 1208 of the nozzle 1200 relative to the base 1209 of the nozzle 1200 is acute and fixed such that the first flow vectoring air outlet 1203 is higher than the second flow vectoring air outlet 1204 on the face 1208 of the nozzle 1200. In the illustrated embodiment, this angle ($\alpha$) is approximately 35 degrees; however, the angle of the face 1208 relative to the base 1209 of the nozzle 1200 could be anything from 0 to 90 degrees, is more preferably from 0 to 45 degrees, and is yet more preferably from 20 to 40 degrees.

In the illustrated embodiment, the nozzle body 1201 comprises an outer casing 1210 that defines the truncated spherical shape. The outer casing 1210 then defines a circular opening 1211 on the circular face 1208 of the nozzle 1200 and a circular opening 1212 at the circular base 1208 of the nozzle 1208. In particular, the nozzle body 1201 comprises a lip 1213 that extends inwardly from the edge of the outer casing 1210 that forms the first truncation. This lip 1213 is generally frustoconical in shape and tapers inwardly towards the centre of the circular face 1208.

The nozzle body 1201 further comprises an inner casing 1214 that is disposed within and fixed to the outer casing 1210 and that defines the single internal air passageway 1206 of the nozzle 1200. The inner casing 1214 has a circular opening at its lower end that is located concentrically within the circular opening of the outer casing at the base 1208 of the nozzle 1200, with this lower circular opening of the inner casing 1214 providing the air inlet 1202 for receiving the airflow from the body 1100. The inner casing 1214 also has a circular opening at its upper end that is located concentrically with the circular opening 1211 of the outer casing 1210 at the face 1208 of the nozzle 1200. An inwardly curved upper end of the inner casing 1214 then meets/abuts with the lip 1213 that tapers inwardly from the outer casing 1210 to define the circular opening 1211 at the circular face 1208 of the nozzle 1200.

A rear portion 1214*a* of the inner casing 1214 then extends between the air inlet 1202 and the first flow vectoring air outlet 1203, whilst an opposing front portion 1214*b* of the inner casing 1214 extends between the air inlet 1202 and the second flow vectoring air outlet 1204. The rear and front portions 1214*a*, 1214*b* of the inner casing 1214 are curved such that the cross-sectional area of the internal air passageway 1206 in a plane that is parallel to either the face 1208 or base 1209 of the nozzle body 1201 varies between the air inlet 1202 and the flow vectoring air outlets 1203, 1204. In particular, the rear and front portions 1214*a*, 1214*b* of the inner casing 1214 widen or flare outwardly away from one another adjacent to the air inlet 1202 and then narrow towards one another adjacent the flow vectoring air outlets 1203, 1204. The cross-sectional area of the air passageway 1206 therefore increases as the air passageway 1206 extends from the air inlet 1202 until it reaches a maximum between the air inlet 1202 and the flow vectoring air outlets 1203, 1204 before decreasing as the internal air passageway 1206 approaches the flow vectoring air outlets 1203, 1204. The rear and front portions 1214*a*, 1214*b* of the inner casing 1214 therefore generally conform to the shape of the nozzle body 1201 to optimise the use of space within the outer casing 1210, and are entirely curved so as to provide a smooth transition for the air flow as it travels from the air inlet 1202 to the flow vectoring air outlets 1203, 1204. The term "curved" as used herein refers to a surface that gradually deviates from planarity in a smooth, continuous fashion.

The inner casing 1214 is then provided with opposing first and second stepped side portions 1214*c*, 1214*d* (i.e. those portions that are generally perpendicular to the front and rear portions 1214*a*, 1214*b*) that each comprise a side wall and an upward facing wall. The first and second side walls of the inner casing 1214 therefore form side walls of the internal air passageway 1206 that are generally flat and generally parallel to a plane that bisects the first and second air outlets 1203, 1204. The first and second upward facing walls of the inner casing 1214 then form ledges that extend away from opposing sides of the internal air passageway 1206 towards adjacent portions of the outer casing 1210, such that the upper end of the inner casing 1214 defines a generally disc-shaped cavity beneath the inwardly curved upper end of the inner casing 1214. The first and second upward facing walls are generally flat and generally parallel to the circular opening 1211 provided at the upper end of the inner casing 1214.

The first stepped side portion 1214*c* of the inner casing 1214 then further comprises a first side duct 1215 that extends radially outward away from the internal air passageway 1206, and the second stepped side portion 1214*d* of the inner casing 1214 further comprises a second side duct 1216 that extends radially outward away from the internal air passageway 1206 in an opposing direction. The first side duct 1215 and the second side duct 1216 are therefore diametrically opposed to one another and are perpendicular to the plane that bisects the first and second air outlets 1203, 1204. Specifically, the first side duct 1215 and the second side duct 1216 each comprise an ingress opening provided in the corresponding side wall, a channel that slopes upwardly towards disc-shaped cavity provided beneath the circular opening 1211 at the face 1208 of the nozzle 1200, and an egress opening or lateral air outlet 1217, 1218 provided in the corresponding upward facing wall that is located beneath the inwardly curved upper end of the inner casing 1214.

The inner casing 1214 further comprises a pair of vanes 1219 that are disposed within the internal air passageway 1206 and that are arranged to straighten the air flow entering the nozzle 1200 through the air inlet 1202 of the nozzle body 1201. The vanes 1219 are flat, generally parallel with a plane that bisects the first and second flow vectoring air outlets 1203, 1204, and extend across the internal air passageway 1206 between the first and second flow vectoring air outlets 1203, 1204 and from a location adjacent to the air inlet 1202 to locations adjacent to each of the first and second flow vectoring air outlets 1203, 1204. In other words, the vanes 1219 extend across the width of the internal air passageway 1206 and across the majority of the depth of the internal air passageway 1206 such that they then extend across the majority of the cross-sectional area of the internal air passageway 1206.

In the illustrated embodiment, the inner casing 1214 further comprises a spindle 1220 that forms a further part of the plain/journal bearing assembly mentioned above. Specifically, the spindle 1220 is disposed at the centre of lower circular opening 1212 of the inner casing 1214 (i.e. at the centre of the air inlet 1202 of the nozzle 1200) and is therefore aligned with the oscillation axis (X) of the nozzle 1200. The spindle 1220 is arranged to fit and rotate within the bearing 1122 provided at centre of the nozzle seat 1121. In the illustrated embodiment, the spindle 1220 comprises a preferably knurled shaft or rod 1220*a* that projects from the inner casing 1214 and a bearing sleeve 1220*b* that is disposed over and retained on the shaft 1220*a*.

In the illustrated embodiment, the nozzle body 1201 further comprises an air inlet guide member 1221 disposed within the internal air passageway 1206 that is arranged to direct an air flow entering the nozzle 1200 through the air inlet 1202 towards the air outlets 1203, 1204, 1217, 1218 of the nozzle 1200. Specifically, the air inlet guide member 1221 has the general shape of an oblique cone and is disposed such that a narrow end or apex of the air inlet guide member 1221 is proximal to the air inlet 1202. The surface of the air inlet guide member 1221 is then shaped so as to generally follow the shape of the opposing portion of the inner casing 1214 so that the air flow entering the nozzle 1200 through the air inlet 1202 is directed along the periphery of the internal air passageway 1206. In the illustrated embodiment, the spindle 1220 of the inner casing 1214 protrudes through an aperture at the narrow end of the air inlet guide member 1221.

The valve member 1207 is then disposed within the nozzle body 1201 adjacent to the circular opening 1211 at the circular face 1208 of nozzle 1200 (i.e. defined by the upper circular opening of the outer casing 1210 and the upper circular opening of the inner casing 1214). Specifically, the valve member 1207 is disposed within the cavity defined by the upper end of the inner casing 1214. The valve member 1207 is then arranged to move translationally (i.e. without rotation) within the nozzle body 1201 between the first end position and the second end position. In particular, the valve member 1207 is arranged to move rectilinearly (i.e. in a straight line) between the first end position and the second end position. Specifically, the valve member 1207 is arranged to move laterally (i.e. sideways, from side to side) relative to the nozzle body 1201 between the first end position and the second end position. The valve member 1207 then has a first end section 1207*a* that maximally occludes the first air outlet 1203 when the valve member 1207 is in the first end position, and an opposing second end section 1207*b* that maximally occludes the second air outlet 1204 when the valve member 1207 is in the second end position. The distal edges of the first and second end sections 1207*a*, 1207*b* of the valve member 1207 are both arcuate in shape so as to correspond with the shape of an opposing surface of the nozzle body 1201. In particular, the distal edges of the first and second end sections 1207*a*, 1207*b* of the valve member 1207 have a radius of curvature that is substantially equal to a radius of curvature of the opposing surface of the nozzle body 1201.

Figure 16:
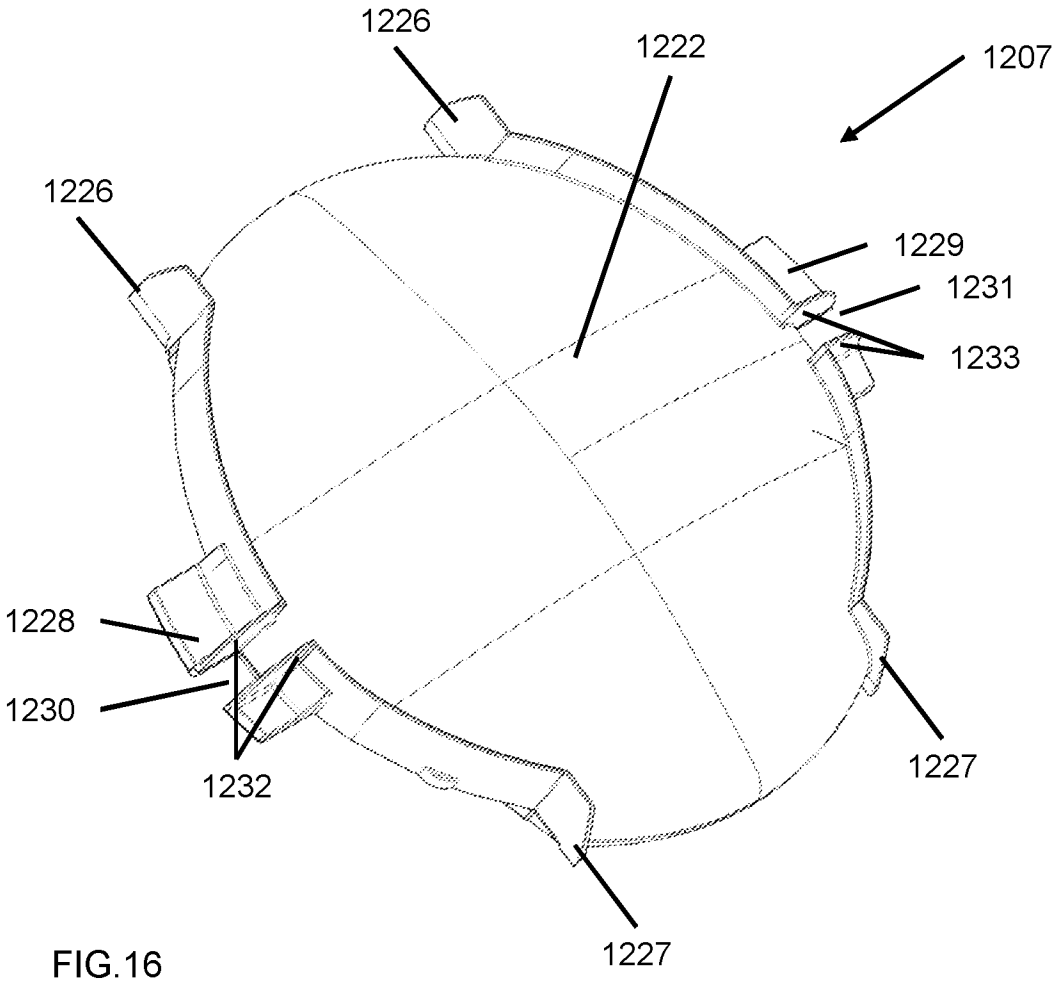
FIG. 16 shows an isometric front view of the valve member of the nozzle of FIG. 12.
Figure 17:
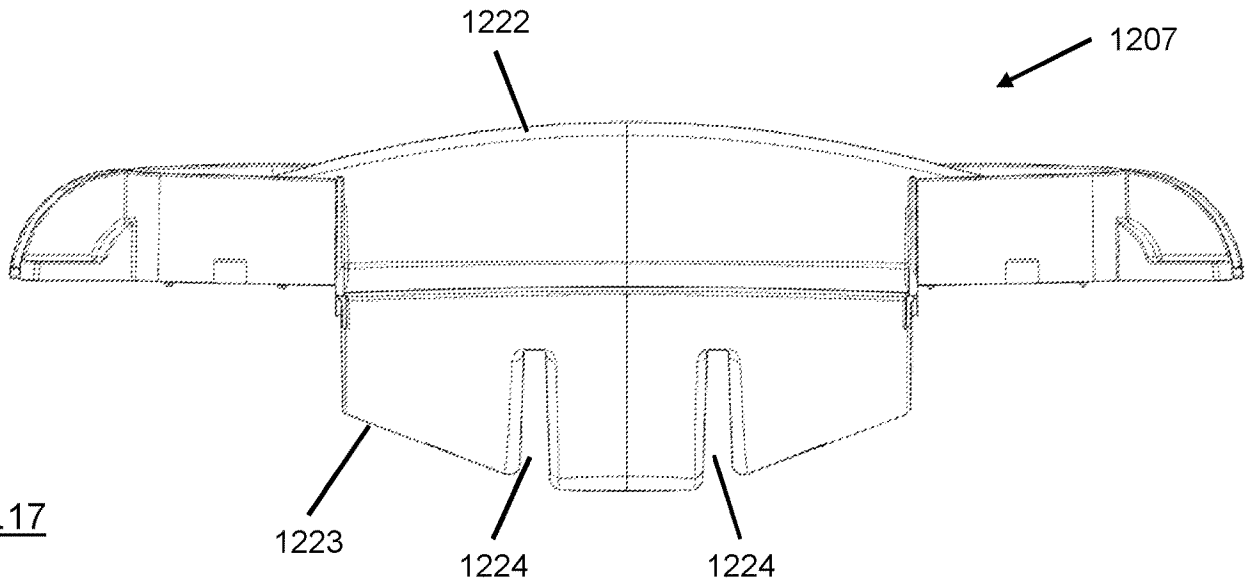
FIG. 17 shows an end on view of the valve member of the nozzle of FIG. 12.
Figure 18:
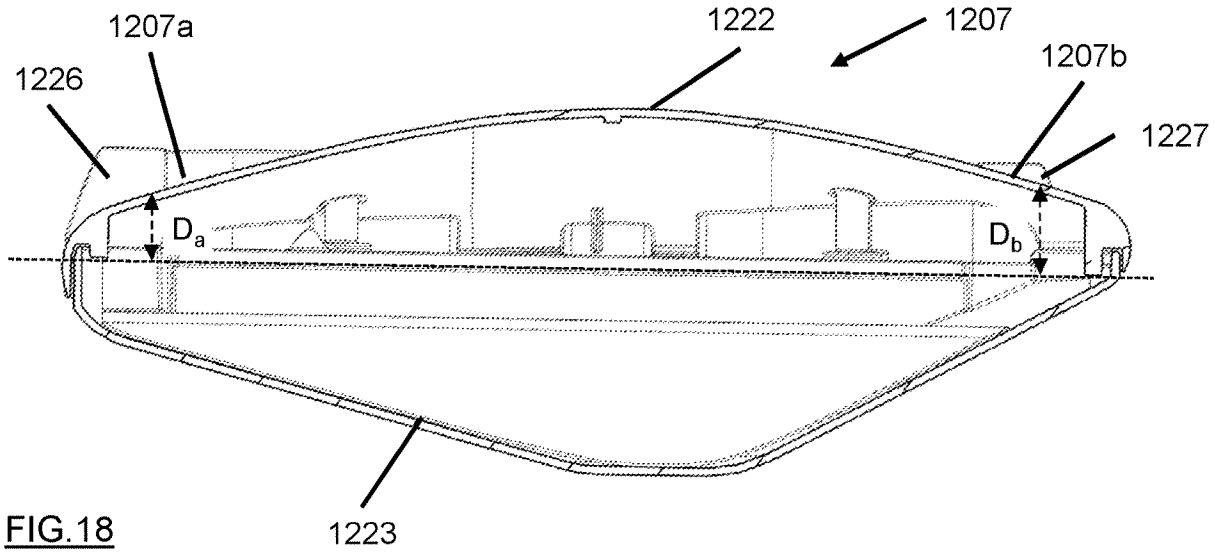
FIG. 18 shows a sectional side view of the valve member of the nozzle of FIG. 12.

FIGS. 16, 17 and 18 show an embodiment of a valve member 1207 suitable for use with the nozzle 1200 described herein. FIG. 16 shows an isometric front view of the valve member 1207, FIG. 17 shows an end on view of the valve member 1207, and FIG. 18 shows a sectional side view of the valve member 1207. In the illustrated embodiment, the valve member 1207 has a generally circular front cross-section and comprises an upper section 1222 and a lower section 1223. An outermost/uppermost surface of the upper section 1222 is generally convex (i.e. bulges outwardly) and is exposed within the opening 1211 provided at the face 1208 of the nozzle 1200. The term "convex" as used herein refers to a surface that bulges outwardly and could therefore either have a curved convex shape or have the shape of a convex polygon consisting at least partially of straight lines. The outermost/uppermost surface of the upper section 1222 therefore forms an external surface of the nozzle body 1201. An innermost/lowermost surface of the lower section 1223 is also generally convex and is disposed within the nozzle body 1201 such that the innermost/lowermost surface faces into the internal air passageway 1206. The innermost/lowermost surface of the lower section 1223 therefore forms an internal surface of the nozzle body 1201, with the convex shape of the innermost/lowermost surface assisting in directing an air flow within the internal air passageway 1206 towards the first and second flow vectoring air outlets 1203, 1204 provided at the periphery of the valve member 1207.

The innermost/lowermost surface of the lower section 1223 is then provided a pair of grooves/tracks 1224 that form part of a sliding mechanism that allows the valve member 1207 to slide (i.e. to move smoothly along a surface) within the nozzle body 1201, laterally (i.e. sideways, from side to side) relative to the opening 1211 provided at face 1208 of the nozzle body 1201 (i.e. move in a plane that is parallel to the opening 1211), through a range of positions between the first end position and the second end position. These grooves/tracks 1224 are arranged such that they fit over the upper portions of the air straightening vanes 1219 when the valve member 1207 is disposed within the nozzle body 1201. The upper portions of the air straightening vanes 1219 therefore provide rails that are disposed within the grooves/tracks 1224 provided in the innermost/lowermost surface of the of the valve member 1207, and therefore provide a further part of the sliding mechanism. Consequently, both the vanes/rails 1219 and the corresponding groove/tracks 1224 are parallel with the plane that bisects the first and second flow vectoring air outlets 1203, 1204 and extend across the internal air passageway 1206 in a direction extending between the first and second flow vectoring air outlets 1203, 1204.

In the illustrated embodiment, the sliding mechanism of the nozzle 1200 further comprises a pair of brakes 1225 that are arranged to resist movement of the valve member 1207 relative to the nozzle body 1201 and thereby retain the position of the valve member 1207 when no external force is applied to the valve member 1207 (i.e. to resist movement of the valve member 1207 when the only applied force is gravity). The resisting force provided by the brakes 1225 is therefore sufficient to retain the position of the valve member 1207 when no external force is applied but can easily overcome by a user-applied/manual force. For example, the resisting force could be easily overcome by a user placing a hand upon the outermost/uppermost surface of the valve member 1207 and pushing or pulling the valve member 1207 towards either the rear or front of the nozzle body 1201. Each brake 1225 comprises a friction pad/member 1225*a* and a resilient member 1225*b* (e.g. a compression spring) arranged to urge the friction pad 1225*a* against a braking surface 1225*c*. Specifically, each brake 1225 is arranged such that the direction in which the resilient member 1225*b* urges the friction pad 1225*a* is substantially orthogonal/perpendicular to the direction in which the valve member 1207 is arranged to move within the nozzle body 1207. In the illustrated embodiment, each brake 1225 is mounted to the valve member 1207 and the braking surface 1225*c* is provided by a portion of the inner casing 1214. The valve member 1207 is therefore provided with a pair of brake seats 1225*d* and the resilient member 1225*b* of each brake 1225 is then located between the corresponding seat 1225*d* and the friction pad/member 1225*a*, and is arranged to urge the friction pad/member 1225*a* towards the valve member 1207. Each brake seat 1225*d* is provided by a projection that extends out of the valve member 1207 and through a corresponding aperture/slot provided in one of the upward facing walls of the inner casing 1214. For each brake 1225, the resilient member 1225*b* therefore urges the friction pad/member 1225*a* against portions of a lower surface of the upward facing wall of the inner casing 1214 that are disposed on opposite sides of the slot.

The first flow vectoring air outlet 1203 is then defined by a first portion of an edge 1211*a* of the circular opening 1211 at the face 1208 of the nozzle 1200 and a first portion 1207*a* of the outermost/uppermost surface of the valve member 1207 that is adjacent to the first portion of the edge 1211*a*, and the second flow vectoring air outlet 1204 is defined by a second portion of the edge 1211*b* of the opening 1211 at the face 1208 of the nozzle 1200 and a second portion 1207*b* of the outermost/uppermost surface of the valve member 1207 that is adjacent to the second portion of the edge 1211*b*. The first portion 1207*a* of the outermost/uppermost surface of the valve member 1207 has a shape that corresponds with a shape of the opposing, first portion of the edge 1211*a* of the circular opening 1211. In particular, first portion 1207*a* of the outermost/uppermost surface of the valve member 1207 has a radius of curvature that is substantially equal to a radius of curvature of the opposing, first portion of the edge 1211*a* of the circular opening 1211. The second portion 1207*b* of the outermost/uppermost surface of the valve member 1207 then has a shape that corresponds with a shape of the opposing, second portion of the edge 1211*b* of the opening 1211. In particular, the second portion 1207*b* of the outermost/uppermost surface of the valve member 1207 has a radius of curvature that is substantially equal to a radius of curvature of the opposing, second portion of the edge 1211*b* of the opening 1211. The first and second flow vectoring air outlets 1203, 1204 therefore comprise a pair of curved slots that are diametrically opposed within the circular opening 1211 defined by the nozzle body 1201 at the face 1208 of the nozzle 1200, and the outermost/uppermost surface of the valve member 1207 extends between the first and second flow vectoring air outlets 1203, 1204.

In the illustrated embodiment, the first and second flow vectoring air outlets 1203, 1204 comprise a pair of congruent, circular arc shaped slots, each having an arc angle (β) (i.e. the angle subtended by the arc at the centre of the circular face 1208) of approximately 60 degrees; however, they could each have an arc angle of anything from 20 to 110 degrees, preferably from 45 to 90 degrees, and more preferably from 60 to 80 degrees. The first and second flow vectoring air outlets 1203, 1204 are also oriented to direct an emitted air flow over a portion of the outermost/uppermost surface of the valve member 1207 that is adjacent to the corresponding air outlet. The outermost/uppermost surface of the valve member 1207 therefore provides an external guide surface of the nozzle body 1201. The external guide surface provided by the outermost/uppermost surface of the valve member 1207 therefore spans an area between (i.e. an area that separates) the first and second air outlets 1203, 1204. In other words, the external guide surface extends across the distance that separates the first and second air outlets 1203, 1204.

As noted above, the sliding mechanism of the valve allows the valve member 1207 to slide laterally within the nozzle body 1201 through a range of positions between a first end position and a second end position. The valve is then arranged within the nozzle body 1201 such that movement of the valve member 1207 adjusts the size of the first flow vectoring air outlet 1203 and simultaneously inversely adjusts the size of the second flow vectoring air outlet 1204. In particular, the valve member 1207 is arranged within the nozzle body 1207 such that, when the valve member 1207 is in the first end position, the first flow vectoring air outlet 1203 is maximally open (i.e. to the maximum extent possible, such that the size of the first flow vectoring air outlet 1203 is at a maximum) and the second flow vectoring air outlet 1204 is maximally occluded (i.e. to the maximum extent possible, such that the size of the second flow vectoring air outlet 1204 is at a minimum) and, when the valve member 1207 is in the second end position, the first flow vectoring air outlet 1203 is maximally occluded and the second flow vectoring air outlet 1204 is maximally open. In other words, the size of the first flow vectoring air outlet 1203 is at a maximum when the valve member 1207 is in the first end position and at a minimum when the valve member is in the second end position, whilst size of the second flow vectoring air outlet 1204 is at a minimum when the valve member 1207 is in the first end position and at a maximum when the valve member 1207 is in the second end position. In particular, when in the first end position, the second portion 1207*b* of the valve member 1207 (i.e. that partially defines the second flow vectoring air outlet 1204) maximally occludes the second flow vectoring air outlet 1204 and, when in the second end positon, the first portion 1207*a* of the valve member 1207 (i.e. that partially defines the first air outlet 1203) maximally occludes the first flow vectoring air outlet 1203.

In addition, in order keep the aggregate/combined size of the first and second flow vectoring air outlets 1203, 1204 constant as the valve member 1207 moves between the first end position and the second end position, an angle defined between the first portion 1207*a* of the valve member 1207 (i.e. that partially defines the first flow vectoring air outlet 1203) and a plane that is parallel to the opening 1211 at the face 1208 of the nozzle 1200 is approximately equal to an angle defined between the second portion 1207*b* of the valve member 1207 (i.e. that partially defines the second flow vectoring air outlet 1204) and the plane that is parallel to the opening 1211 at the face 1208 of the nozzle 1200. In this regard, the first and second portions 1207*a*, 1207*b* of the valve member 1207 can be flat or slightly curved. If curved, then the angles defined by the first portion 1207*a* and second portion 1207*b* respectively are the angles of a chord of the curve, wherein a chord is the line segment joining two points on a curve. The matching angles ensure that the first and second flow vectoring air outlets 1203, 1204 open and close at the same rate when the valve member 1207 is moved laterally so that the aggregate size of the first and second flow vectoring air outlets 1203, 1204 remains substantially constant irrespective of the position of the valve member 1207.

In the illustrated embodiment, the valve member 1207 is arranged such that the difference in size between the first flow vectoring air outlet 1203 and the second flow vectoring air outlet 1204 when the valve member 1207 is in the first end position is greater than the difference in size between the first flow vectoring air outlet 1203 and the second flow vectoring air outlet 1204 when the valve member 1207 is in the second end position. Specifically, the size of the first flow vectoring air outlet 1203 when the valve member 1207 is in in the first end position (i.e. when the first flow vectoring air outlet 1203 is maximally open) is greater than the size of the second flow vectoring air outlet 1204 when the valve member 1207 is in the second end position (i.e. when the second flow vectoring air outlet 1204 is maximally open), and the size of the first flow vectoring air outlet 1203 when the valve member 1207 is in the second end position (i.e. when the first flow vectoring air outlet 1203 is maximally occluded) is greater than the size of the second flow vectoring air outlet 1204 when the valve member 1207 is in the first end position (i.e. when the second flow vectoring air outlet 1204 is maximally occluded).

This arrangement provides that the vectoring range of the airflow generated by the nozzle 1200 is biased towards the second flow vectoring air outlet 1204 provided towards the front of the nozzle 1200, which is particularly advantageous when the fan assembly 1000 is intended to provide the resultant airflow to a single user, especially when the fan assembly 1000 is disposed on a raised surface, such as a table or desk, next to the user. To achieve a portion of this bias, the valve member 1207 is provided with valve end stops 1226, 1227 that are arranged to limit the movement of the valve member 1207 beyond suitable end positions. In the illustrated embodiment, the valve member 1207 is provided with a first pair of valve end stops 1226 that project from the first portion 1207*a* of the outermost/uppermost surface of the valve member 1207 (i.e. that partially defines the first flow vectoring air outlet 1203) and a second pair of valve end stops 1227 that project from the second portion 1207*b* of the outermost/uppermost surface of the valve member 1207 (i.e. that partially defines the second flow vectoring air outlet 1204). The first pair of valve end stops 1226 are arranged to abut against a portion of the inner casing 1214 that is adjacent to the first flow vectoring air outlet 1203 when in the second end position, whilst the second pair of valve end stops 1227 are arranged to abut against a portion of the inner casing 1214 that is adjacent to the second flow vectoring air outlet 1204 when in the first position. The distance that the first pair of valve end stops 1226 extend from the valve member 1207 is less than the distance that the second pair of valve end stops 1227 extend from the valve member 1207 such that the size of the first flow vectoring air outlet 1203 when the valve member 1207 is in the second end position is greater/larger than the size of the second flow vectoring air outlet 1204 when the valve member 1207 is in the first end position. In the illustrated embodiment, both the first pair of valve end stops 1226 and the second pair of valve end stops 1227 are provided by pairs of planar projections that extend away from the edge of the valve member 1207 at opposite ends of the valve member 1207. These planar projections can therefore also act as baffles that assist with channelling the air emitted from the first and second flow vectoring air outlets 1203, 1204 in convergent directions over the outermost/uppermost surface of the valve member 1207.

In the illustrated embodiment, the outermost/uppermost surface of the valve member 1207 also has an asymmetric profile/cross-section. In particular, the valve member 1207 has a profile in which the depth (Da) of the outermost/uppermost surface of the valve member 1207 at the first portion 1207*a* (i.e. that partially defines the first flow vectoring air outlet 1203) is less than the depth (Db) of the outermost/uppermost surface at the second portion 1207*b* (i.e. that partially defines the second flow vectoring air outlet 1204). Consequently, the valve is arranged such that, in a direction that is perpendicular to the opening 1211 and to the lateral movement of the valve member 1207, a minimum distance between the edge of the opening 1211 and the outermost/uppermost surface of the valve member 1207 is greater at the first flow vectoring air outlet 1203 than at the second flow vectoring air outlet 1204. In this regard, the minimum distance at the first flow vectoring air outlet 1203 is the distance between the first portion of the edge 1211*a* of the opening 1211 and the first portion 1207*a* of the outermost/uppermost surface of the valve member 1207 when the valve member 1207 is in the second end position, and the minimum distance at the second flow vectoring air outlet 1204 is the distance between the second portion of the edge 1211*b* of the opening 1211 and the second portion 1207*b* of the outermost/uppermost surface of the valve member 1207 when the valve member 1207 is in the first end position. This asymmetry provides that the vectoring range of the airflow generated by the nozzle 1200 is biased towards the second flow vectoring air outlet 1204 provided towards the front of the nozzle 1200, as the minimum airflow emitted from the first flow vectoring air outlet 1203 will be greater than the minimum airflow emitted from the second flow vectoring air outlet 1204. In addition, this asymmetry provides that the lateral range of movement of the valve member 1207 can be maximized for the desired change in the size of the first and second flow vectoring air outlets 1203, 1204, thereby increasing the granularity of control available to the user. A suitable asymmetric profile can be achieved by taking a symmetric profile and merely trimming one end of the profile, as doing so then ensures that whilst one portion of the valve member 1207 is shorter than the other, the angles of the two portions relative to the opening 1211 (and to the direction of motion of the valve member 1207) remain equal so that the aggregate/combined size of the first and second flow vectoring air outlets 1203, 1204 is constant as the valve member 1204 moves between the first end position and the second end position.

As described above, the inner casing 1214 comprises a first side duct 1215 and a diametrically opposed second side duct 1216 that extend radially outward away from the internal air passageway 1206, and slope upwards towards the circular opening at the face 1211 of the nozzle 1200. These side ducts 1215, 1216 therefore channel a portion of the airflow from within the internal air passageway 1206 to their corresponding egress openings, or lateral air outlets 1217, 1218, that face into the generally disc-shaped cavity defined by the upper end of the inner casing 1214. The nozzle 1200 is then configured to direct any air flow that is emitted from these lateral air outlets 1217, 1218 towards the point at which the air flows emitted from the first and second flow vectoring air outlets 1203, 1204 converge. In this regard, these lateral air outlets 1217, 1218 are configured to only emit a relatively small portion of the air flow generated by the motor-driven impeller 1210. The relatively small jets of air that are emitted from the lateral air outlets 1217, 1218 then support the collision of the air flows emitted from the flow vectoring air outlets 1203, 1204, and thereby provide an increase in the velocity of the resultant air flow generated by the nozzle 1200, without significantly reducing the flow of air through the flow vectoring air outlets 1203, 1204.

In the illustrated embodiment, the nozzle 1200 is configured such that approximately 12.5% of the total air flow generated by the motor-driven impeller 1210 can be emitted from the lateral air outlets 1217, 1218, whilst the remaining air flow is emitted from the flow vectoring air outlets 1203, 1204 of the nozzle 1200 that are used to provide variable control of the direction of the resultant air flow. Consequently, the area of each of the lateral air outlets 1217, 1218 is approximately 6.25% of the total area of the outlets provided by the nozzle 1200, wherein this total area is the combined area of the two lateral air outlets 1217, 1218 and the aggregate area of the flow vectoring air outlets 1203, 1204 of the nozzle 1200. However, the area of each of the lateral air outlets 1217, 1218 could be more or less than this. For example, the area of each of the lateral air outlets 1217, 1218 could be from 12.5% to 4% of the total area of the outlets provided by the nozzle 1200.

In the illustrated embodiment, the valve member 1207 is also provided with diametrically opposed first and second flange portions 1228, 1229 that project radially outward from the peripheral edge of the valve member 1207. These first and second flange portions 1228, 1229 each comprise a slot or aperture 1230, 1231 that is arranged to be disposed over/aligned with the lateral air outlet 1217, 1218 of the corresponding side duct 1215, 1216 when the valve member 1206 is located at a position in which the air flows emitted from the first and second flow vectoring air outlets 1203, 1204 are approximately equal, and to be displaced away from the lateral air outlet 1217, 1218 of the corresponding side duct 1215, 1216 when the valve member 1207 is moved away from this position. Consequently, the size of the lateral air outlets 1217, 1218 is dependent upon the position of the valve member 1207, and movement of the valve member 1207 simultaneously adjusts the size of the lateral air outlets 1217, 1218. Specifically, the first and second flange portions

1228, 1229 are arranged such that the lateral air outlets 1217, 1218 are maximally open when the size of the first air outlet 1203 is approximately equal to the size of the second air outlet 1204 and are maximally occluded/closed when the difference in size between the first flow vectoring air outlet 1203 and the second flow vectoring air outlet 1204 is at a maximum. As will be described in more detail below, in the illustrated embodiment the size of the first air outlet 1203 is approximately equal to the size of the second air outlet 1204 when the valve member 1207 is in the in the second end position, and the difference in size between the first flow vectoring air outlet 1203 and the second flow vectoring air outlet 1204 is at a maximum when the valve member 1207 is in the first end position. The valve member 1207 then further comprises, for each slot 1230, 1231, a pair of side baffles 1232, 1233 that are arranged to assist with channeling the air emitted from the corresponding lateral air outlet 1217, 1218 in convergent directions over the outermost/uppermost surface of the valve member 1207.

As described above, the nozzle 1200 is releasably mounted on, and therefore detachable from, the fan body 1100. The nozzle 1200 therefore comprises a nozzle retaining mechanism for releasably retaining the nozzle 1200 on the fan body 1100. The nozzle retaining mechanism has a first configuration in which the nozzle 1200 will be retained on the fan body 1100 and a second configuration in which the nozzle 1200 is released for removal from the fan body 1100. The nozzle retaining mechanism is also arranged to biased towards the first configuration such that the nozzle retaining mechanism will retain the nozzle 1200 on the fan body 1100 unless placed into the second configuration by a user.

In the illustrated embodiment, the nozzle 1200 comprises a pair of nozzle retaining mechanisms 1234, 1235 that are diametrically opposed within the nozzle body 1201. These nozzle retaining mechanisms 1234, 1235 are disposed in a space defined between the side portions of the inner casing 1214 and the outer casing 1210 of the nozzle body 1201. Each of these nozzle retaining mechanisms 1234, 1235 comprises a retention element 1234*a*, 1235*a* in the form of a catch that is moveable relative to the nozzle 1200 and the fan body 1100 between the first configuration and the second configuration. Each of these nozzle retaining mechanisms then further comprise a manually actuable member 1234*b*, 1235*b* for effecting movement of the retention element 1234*a*, 1235*a* from the first configuration to the second configuration. Specifically, each manually actuable member 1234*b*, 1235*b* takes the form of a depressible button that projects into a corresponding aperture provided in the outer casing 1210 of the nozzle body 1201, such that these depressible buttons can be accessed by a user in order to actuate the moveable catch 1234*a*, 1235*a* to release the nozzle 1200 from the fan body 1100.

Specifically, for each nozzle retaining mechanism, the depressible button 1234*b*, 1235*b* and the moveable catch 1234*a*, 1235*a* are formed as a single component latch that is pivotally mounted within the outer casing 1210 of the nozzle body 1201, with the depressible button 1234*b*, 1235*b* being provided at one end and the catch 1234*a*, 1235*a* being provided at the other. A biasing member 1234*c*, 1235*c* in the form of a compression spring is then disposed between a rear surface of the depressible button 1234*b*, 1235*b* and an inner portion of the nozzle body 1201 that biases the latch towards the outer casing 1214, into the first configuration. Pressure on the depressible button 1234*b*, 1235*b* against the force of the compression spring 1234*c*, 1235*c* therefore causes the latch to pivot such that the catch 1234*a*, 1235*a* moves to the second configuration for removal of the nozzle 1200 from the fan body 1100. As described above, the nozzle seat 1121 of the fan body 1100 has a ledge/lip 1128 that projects radially inward so as to partially overhang the accurate recess 1127. The nozzle retaining mechanism is therefore arranged such that the catch 1234*a*, 1235*a* is obstructed by this ledge 1128 when the nozzle 1200 is disposed on the fan body 1100 with the nozzle retaining mechanism in the first configuration, thereby preventing separation of the nozzle 1200 from the body 1100, and such that the catch 1234*a*, 1235*a* is clear of/unobstructed by this ledge 1128 when the nozzle 1200 is disposed on the fan body 1100 with the nozzle retaining mechanism in the second configuration, thereby allowing separation of the nozzle 1200 from the body 1100.

As described above, the nozzle 1200 further comprises the driven portion of the oscillation mechanism, wherein the driven portion comprises a driven member 1205 that is arranged to be driven by the drive member 1130 to rotate the nozzle body 1201 around an oscillation axis (X). In the illustrated embodiment, the driven member 1205 comprises an at least partially circular or arcuate rack that is arranged such that, when the nozzle 1200 is disposed on the fan body 1100, the rack engages the pinion 1130 on the fan body 1100 that provides the drive member of the oscillation mechanism. Specifically, the rack 1205 comprises a set of teeth located which mesh with teeth provided on the pinion 1130 when the nozzle 1200 is disposed on the fan body 1100. In the embodiment illustrated in FIG. 9, the rack 1205 comprises a spur rack having a plurality of radially projecting teeth that are straight and aligned parallel to the axis of rotation (X) but in which an edge of the lower portion of the rack 1205 is chamfered. Specifically, both the root and teeth of the lower portion of the rack 1205 are chamfered, with the root angle of the chamfered portion preferably being approximately 45 degrees. The chamfered upper portion of the pinion 1130 and the chamfered lower portion of the rack 1205 therefore assist with meshing of the rack 1205 and pinion 1130 when the nozzle 1200 is placed on to the fan body 1100 by ensuring that they mesh properly, whilst also minimising the risk of damage that could occur when the teeth collide.

As described above, in the illustrated embodiment the pinion 1130 is disposed radially outward relative to the annular air vent 1123 of the fan body 1100. The rack 1205 is therefore disposed radially outward relative to the air inlet 1202 of the nozzle body 1201. Specifically, the rack 1205 is attached on a peripheral surface of the inner casing 1214, towards the lower end of the inner casing (i.e. adjacent to the air inlet into the internal air passageway), with the teeth of the rack being provided on a peripheral portion of the rack and projecting radially outward.

The nozzle 1200 then further comprises a pair of nozzle stops 1236, 1237 provided on the nozzle body 1201 that are each arranged to prevent the nozzle body 1201 from rotating beyond an end of the range of oscillation of the nozzle body 1201. In particular, a first nozzle stop 1237 is arranged to prevent the nozzle body 1201 from rotating beyond a first end of the range of oscillation of the nozzle body 1201, and a second nozzle stop 1237 is arranged to prevent the nozzle body 1201 from rotating beyond an opposite, second end of the range of oscillation of the nozzle body 1201. In the illustrated embodiment, the first nozzle stop 1236 is provided by a first projection that extends radially outward from the inner casing 1214 of the nozzle 1200 and that is arranged to contact/abut against a corresponding portion of the fan body 1100 when the nozzle body 1201 reaches the first end of the range of oscillation. The second nozzle stop 1237 is then provided by a second projection that extends radially outward from the inner casing 1214 of the nozzle 1200 and that is arranged to contact/abut against a corresponding portion of the fan body 1100 when the nozzle body 1201 reaches the second end of the range of oscillation. Specifically, the first nozzle stop 1236 is arranged to abut against a first side of the raised portion of the nozzle seat 1121 when the nozzle body 1201 reaches the first end of the range of oscillation, and the second nozzle stop 1237 is arranged to abut against an opposite, second side of the raised portion of the nozzle seat 1121 when the nozzle body 1201 reaches the second end of the range of oscillation.

The first and second nozzle stops 1236, 1237 are also arranged to prevent the nozzle 1200 from being mounted on to the fan body 1100 when the nozzle body 1201 is in an orientation relative to the fan body 1100 that is outside the range of oscillation of the nozzle body 1201. To do so, the first and second nozzle stops 1236, 1237 are arranged to contact the upper surface of the raised portion of the of the nozzle seat 1121 if the nozzle 1200 is lowered towards the fan body 1100 whilst the nozzle body 1201 in an orientation relative to the fan body 1100 that is outside the range of oscillation, and thereby prevent the nozzle 1200 from being brought sufficiently close to the fan body 1100 for the nozzle retaining mechanisms 1234, 1235 to become engaged with the fan body 1100. Specifically, the first nozzle stop 1236 is arranged to contact the upper surface of the of the raised portion of the of the nozzle seat 1121 if the nozzle 1200 is lowered towards the fan body 1100 whilst the nozzle body 1201 is in an orientation relative to the fan body 1100 that is beyond the first end of the range of oscillation, and the second nozzle stop 1237 is arranged to contact the upper surface of the of the raised portion of the of the nozzle seat 1121 if the nozzle 1200 is lowered towards the fan body 1100 whilst the nozzle body 1201 is in an orientation relative to the fan body 1100 that is beyond the second end of the range of oscillation.

The nozzle 1200 then further comprises a complimentary part of the orientation detection mechanism. As described above, the fan body 1100 is provided with a photo-interrupter 1131 as a part of a mechanism for detecting the orientation of the nozzle body 1201 when the nozzle 1200 is mounted on the fan body 1100. In the illustrated embodiment, the complimentary part of the orientation detection mechanism that is provided on the nozzle body 1201 comprises an at least partially circular/arcuate screen/shield 1238 that depends/projects from the nozzle body 1201 and that is arranged to be detected by the photo-interrupter 1131 when the nozzle body 1201 is in one of the two halves of the range of oscillation. Specifically, this shield 1238 is arranged to be located within the arcuate recess 1127 of the nozzle seat 1121 when the nozzle 1200 is attached to the fan body 1100. Consequently, when the nozzle body 1201 is in a first of the two halves of the range of oscillation, the shield 1238 will be located within the gap between the light emitting elements and the light receiving elements of the photo-interrupter 1131 thereby preventing light from the light emitting elements from reaching the light receiving elements. When the nozzle body 1201 is in a second of the two halves of the range of oscillation, the shield 1238 will be clear of the gap such that light from the light emitting elements will reach the light receiving elements.

The photo-interrupter 1131 is arranged to provide its output as an input to the control circuit 1106. The control circuit 1106 is then configured to use the input from the photo-interrupter 1131 to control the oscillation motor 1129. In particular, initially the input received from the photo-interrupter 1131 will indicate either that the gap is blocked and that the nozzle body 1201 is therefore in the first of the two halves of the range of oscillation, or that the gap is clear and that the nozzle body 1201 is therefore in the second of the two halves of the range of oscillation. The control circuit 1106 is then configured to operate the oscillation motor 1129 such that the nozzle body 1201 is rotated towards the mid-point of the range of oscillation. Upon reaching the mid-point, the edge of the shield 1238 will pass through the gap such that the photo-interrupter 1131 will transition between being blocked and being clear, and the control circuit 1106 will thereby determine that the nozzle body 1206 is at the mid-point of the range of oscillation. The control circuit 1106 will then be configured to apply one or both of a limit on the distance of rotation (e.g. defined by the number of steps taken by a stepper motor) and a time limit to control the oscillation motor 1129 so as to limit the rotation of the nozzle body 1201 to within the oscillation range.

The nozzle 1200 further comprises a base member 1239 that is arranged to contact the fan body 1100 when the nozzle 1200 is mounted on the fan body 1100. The nozzle body 1200 is arranged to be rotatable relative to the base member 1239 such that, when the nozzle 1200 is attached to the fan body 1100, the base member 1239 can remain stationary relative to the fan body 1100 whilst the nozzle body 1201 rotates relative to both the fan body 1100 and the base member 1239 of the nozzle 1200. The base member 1209 then comprises an upper filter sealing element **1239*a* that is arranged such that, when the nozzle 1200 is attached to the fan body 1100, the upper filter sealing element 1239*a* contacts both an upper surface of the filter assembly 1111 and an inner surface of the fan body 1100 to prevent leakage of air around the top end of the filter assembly 1111**.

In the illustrated embodiment, the base member 1239 further comprises an annular plate **1239*b*. The upper filter sealing element 1239*a* is then also annular and is attached to a lower surface of the annular plate 1239*b*. The upper filter sealing element 1239*a* comprise two separate flap seal portions, with a first seal portion projecting radially inward and a second seal portion that extends downward and radially outward. The upper filter sealing element 1239*a* is therefore arranged such that, when the nozzle 1200 is attached to the fan body 1100, the first seal portion contacts and forms a seal against an upper portion of the inner wall 1109 of fan body 1100, whilst the second seal portion contacts and forms a seal against an upper end cap 1136 of the filter assembly 1111. The upper filter sealing element 1239*a*** may conveniently be formed from a rubber material.

The nozzle body 1201 then further comprises a plurality of runners 1240 that are attached towards the base 1209 of the nozzle body 1201 and that are arranged to retain the base member 1239 whilst allowing the base member 1239 to rotate relative to the nozzle body 1201. The term "runner" as used herein refers to a mechanical part intended to guide movement. In the illustrated embodiment, each runner 1240 comprises a groove that is arranged to receive a portion of the base member 1239. The base member 1239 then further comprises a flange/rail **1239*c* that is disposed and arranged to slide within each of the plurality of runners 1240. In the illustrated embodiment, the flange/rail 1239*c* is provided on an upper surface the annular plate 1239*b* and projects radially relative to the oscillation axis (X) of the nozzle body 1201**.

To make use of the fan assembly 1000, the user first detaches the nozzle 1200 from the nozzle body 1100. To do so, the user presses on the depressible buttons 1234*b*, 1235*b* of the nozzle retaining mechanisms that are accessible through the outer casing 1210 of the nozzle body 1201 thereby causing the latches to pivot such that the corresponding catches 1234*a*, 1235*b* move to the second configuration. The user then lifts the nozzle 1200 away from the fan body 1100, in a direction that is parallel to the longitudinal axis (X) of the fan assembly 1000, to expose the upper end of the fan body 1100, including the nozzle seat 1121 and the open upper end of the outer compartment. The user then lowers the filter assembly 1111 into the outer compartment until the bottom end cap 1135 rests upon the filter seat 1139 with the filter assembly 1111 surrounding the entire periphery of the inner wall 1109 of the fan body 1100.

The user then reattaches the nozzle 1200 on to the fan body 1100. To do so, the user roughly aligns the nozzle 1200 with upper end of the fan body 1100 and lowers the nozzle 1200 towards the fan body 1100. The circular opening 1212 defined by the outer casing 1210 at the circular base 1209 of the nozzle 1200 is arranged to fit closely over the upper end of the fan body 1100 such that, as the nozzle 1200 moves towards the fan body 1100, the upper end of the fan body 1100 first enters into the circular opening 1212. Consequently, if there is significant misalignment between the nozzle 1200 and the fan body 1100, the edge of the circular base 1209 of the nozzle 1200 will collide with the edge of the upper end of the fan body 1100, indicating to the user that they need to reposition the nozzle 1200 relative to the fan body 1100. As the upper end of the fan body 1100 moves into the circular base 1209 of the nozzle 1200, the spindle 1220 provided on the nozzle 1200 that forms part of the plain bearing assembly enters the hollow of the bearing 1122 provided at the centre of the nozzle seat 1121. If there is any misalignment between the nozzle 1200 and the fan body 1100, then the chamfered inner edge of the bearing 1122 assists in guiding the spindle 1220 into the bearing 1122.

As the circular base 1209 of the nozzle 1200 moves further over the upper end of the fan body 1100, the upper filter sealing element 1239*a* that is attached to a lower surface of the annular plate 1239*b* contacts both the fan body 1100 and the filter assembly 1111. Specifically, the first seal portion of the upper filter sealing element 1239*a* contacts the upper portion of the inner wall 1109 of fan body 1100 thereby forming a seal between the nozzle 1200 and the inner wall 1109 of the fan body 1100. The second seal portion of the upper filter sealing element 1239*a* then contacts the upper end cap 1139 of the filter assembly 1111 that is disposed within the outer compartment thereby forming a seal between the nozzle 1200 and the filter assembly 1100. The drive member 1130 of the oscillation mechanism then engages with the driven member 1205 of the oscillation mechanism. Specifically, the rack 1205 provided on the nozzle 1200 then meshes with the pinion 1130 provided on the fan body 1100, with the chamfering of both a lower edge of the rack 1205 and an upper edge of the pinion 1130 assisting with the alignment of the teeth of the rack 1205 with the teeth of the pinion 1130.

As the circular base 1209 of the nozzle 1200 moves further over the upper end of the fan body 1100, the catches 1234*a*, 1235*a* of the retaining mechanism contact the ledge 1128 provided on the nozzle seat 1121. This contact causes the latches 1234, 1235 to pivot against the force of the corresponding compression spring 1234*c*, 1235*c* such that the catches 1234*a*, 1235*a* pass over the ledge 1128. Once the catches 1234*a*, 1235*a* are clear of the ledge 1128 the force of the compression springs 1234*c*, 1235*c* pivots the latches 1234, 1235 back into the first configuration so that the nozzle 1200 is retained on the fan body 1100. The air inlet 1202 of the nozzle body 1201 also contacts the body outlet sealing member 1125 provided around the periphery of the annular vent 1123 on the nozzle body 1100 and thereby forms a seal between the fan body 1100 and the internal air passageway 1206 of the nozzle 1200, with the nozzle alignment surface 1126 disposed around the periphery of the body outlet sealing member 1125 guiding the air inlet 1202 of the nozzle 1200 into alignment with the air outlet 1123 of the body 1100.

The user then interacts with the fan assembly 1100 (e.g. using a remote control) to provide control inputs that are received by the control circuit 1106. In response to these inputs, the control circuit 1106 can start the motor 1119 in order to rotate the impeller 1110 and generate an air flow through the fan assembly 1000. Specifically, the rotation of the impeller 1110 draws air through the air inlet 1103 of the fan body 1100, which is provided by the apertures in the side wall of the outer casing 1101, and then through the filter assembly 1111. The resulting filtered air is then drawn through the air inlet 1112 of the inner compartment, which is provided by the apertures provided in the lower portion of the inner wall 1109, before entering the impeller housing 1114 through the air inlet 1115 provided at the bottom of the impeller housing 1114. The air then exits the impeller housing 1114 through the air outlet 1116 provided at the top of the impeller housing 1114 before being exhausted from the body 1100 of the fan assembly 1000 through the air vent 1123 provided by the nozzle seat 1121 and into the internal passageway of 1206 the nozzle 1200 through the air inlet 1202 provided by the lower circular opening of the inner casing 1214 of the nozzle body 1201.

Once within the internal passageway 1206 of the nozzle 1200, the air inlet guide member 1221 directs the air flow entering the nozzle 1200 toward the periphery of the internal air passageway 1206, whilst the vanes 1219 provided within the internal air passageway 1206 also straighten the air flow towards the air outlets 1203, 1204 of the nozzle 1200. The innermost/lowermost surface of the lower section of the valve member 1207 then also assists with the directing the air flow within the internal air passageway 1206 of the nozzle 1200 towards the first and second air flow vectoring outlets 1203, 1204 provided at the periphery of the valve member 1207.

The first flow vectoring air outlet 1203, the second flow vectoring air outlet 1204 and the outermost/uppermost surface of the of the valve member 1207 are then arranged such that the air flows emitted from the first and second flow vectoring air outlets 1203, 1204 are directed over a portion of the outermost surface 1207*a*, 1207*b* of the valve member 1207 that is adjacent to the respective air outlet 1203, 1204. In particular, the flow vectoring air outlets 1203, 1204 are arranged to emit an air flow in a direction that is substantially parallel to the portion of the outermost surface 1207*a*, 1207*b* of the valve member 1207 that is adjacent to the air outlet 1203, 1204. The convex shape of the outermost surface of the valve member 1207 then provides that the air flows emitted from the first and second flow vectoring air outlets 1203, 1204 will depart from the outermost surface of the valve member 1207 as they approach one another so that these air flows can collide without interference from the outermost surface of the valve member 1207. When the emitted air flows collide, a separation bubble is formed that can assist in stabilising the resultant jet or combined air flow formed when two opposing air flows collide.

Figure 19A:
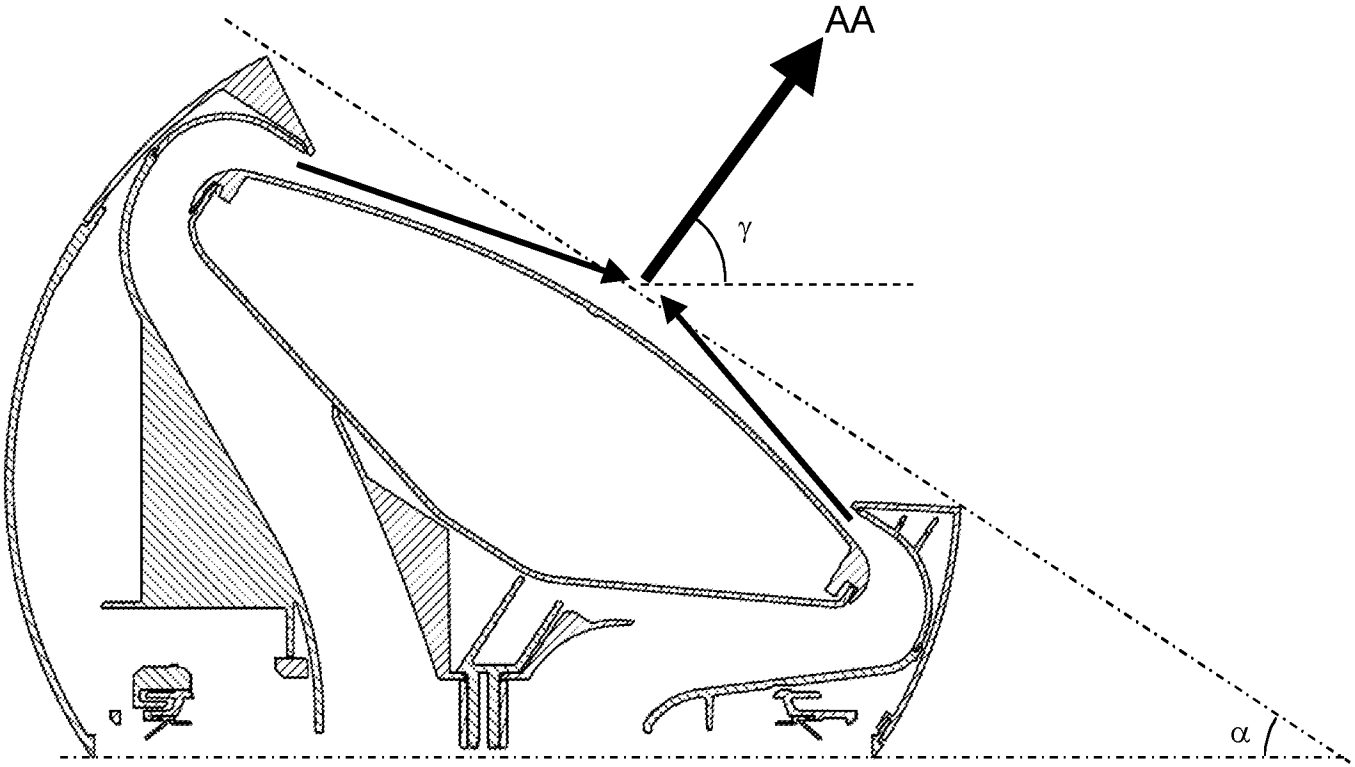
FIG. 19*a* is a simplified vertical cross-sectional view of the nozzle of FIG. 12 illustrating the valve member in a second end position.
Figure 19B:
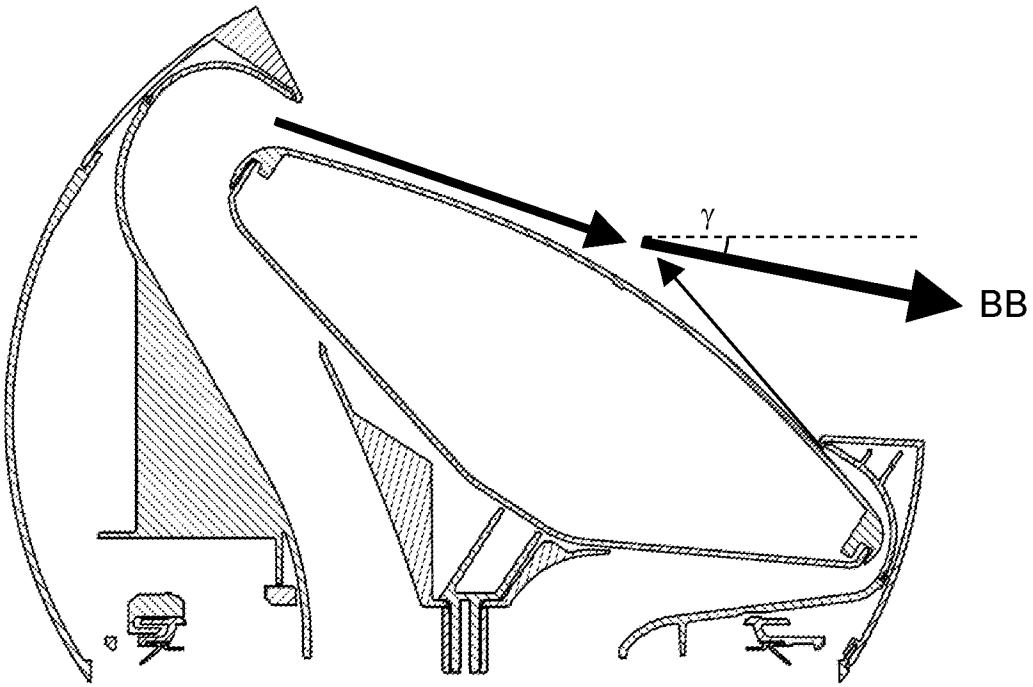
FIG. 19*b* is a simplified vertical cross-sectional view of the nozzle of FIG. 12 illustrating the valve member in a first end position.

As described above, the valve is then arranged to control the direction of the air flow generated by the nozzle 1200 by simultaneously adjusting the size of the first flow vectoring air outlet 1203 and inversely adjusting the size of the second flow vectoring air outlet 1204. In the illustrated embodiment, the sliding mechanism of the valve allows the valve member 1207 to slide laterally within the nozzle body 1201 through a range of positions between the first end position, in which the first flow vectoring air outlet 1203 is maximally open and the second flow vectoring air outlet 1204 is maximally occluded, and the second end position, in which the first flow vectoring air outlet 1203 is maximally occluded and the second air outlet 1204 is maximally open. FIGS. 19A and 19B therefore show two potential resultant air flows that can be achieved by varying the size of the first flow vectoring air outlet 1203 relative to the size of the second flow vectoring air outlet 1204.

In FIG. 19A, the valve is arranged with the valve member 1207 in the second end position, in which the first flow vectoring air outlet 1203 is maximally occluded and the second flow vectoring air outlet 1204 is maximally open. As described above, the vectoring range of the airflow generated by the nozzle 1200 is biased towards the second flow vectoring air outlet 1204 provided towards the front of the nozzle 1200 by valve end stops 1226, 1227 that are arranged to limit the movement of the valve member 1207 beyond suitable end positions. In the embodiment illustrated in FIG. 19A, the first pair of valve end stops 1226 are arranged to abut against a portion of the inner casing 1214 that is adjacent to the first flow vectoring air outlet 1203 when the first flow vectoring air outlet 1203 is approximately the same size as the second flow vectoring air outlet 1204. Consequently, the amount of air flow that is emitted from both the first flow vectoring air outlet 1203 and the second flow vectoring air outlet 1204 when in the second end position is approximately equal such that the resultant air flow arising from their collision will be directed generally upward (i.e. substantially perpendicular relative to the face 1208 of nozzle 1200), as indicated by arrows AA.

In addition, in the illustrated embodiment, the first and second flange portions 1228, 1229 of the valve member 1207 are arranged such that the lateral air outlets 1217, 1218 are maximally open when the valve member 1207 is in the second end position (i.e. when the size of the first flow vectoring air outlet 1203 is approximately equal to the size of the second flow vectoring air outlet 1204). Consequently, a relatively small portion of the total air flow generated by the motor-drive impeller 1110 will therefore be emitted from the lateral air outlets 1217, 1218 and channeled over the outermost/uppermost surface of the valve member 1207 towards the point at which the air flows emitted from the first and second flow vectoring air outlets 1203, 1204 converge.

In FIG. 19B, the valve is arranged with the valve member 1207 in the first end position, in which the first flow vectoring air outlet 1203 is maximally open and the second flow vectoring air outlet 1204 is maximally occluded. In the embodiment illustrated in FIG. 19B, the second pair of end stops 1227 are arranged to abut against a portion of the inner casing 1214 that is adjacent to the second flow vectoring air outlet 1204 when the second flow vectoring air outlet 1204 is mostly, but not entirely, occluded. Consequently, the amount of air flow that is emitted from the first flow vectoring air outlet 1203 will be considerably more than that emitted from the second flow vectoring air outlet 1204 such that the resultant air flow arising from their collision will be directed generally downwards from (i.e. in a direction that is substantially parallel to the direction of the air flow emitted from the first flow vectoring air outlet 1203) the face 1208 of nozzle 1200, as indicated by arrows BB.

In addition, in the illustrated embodiment, the first and second flange portions 1228, 1229 of the valve member 1207 are arranged such that the lateral air outlets 1217, 1218 are maximally occluded/closed when the valve member 1207 is in the first end position (i.e. when the difference in size between the first flow vectoring air outlet 1203 and the second flow vectoring air outlet 1204 is at a maximum). Consequently, none of the air flow generated by the motor-drive impeller 1110 will be emitted from the lateral air outlets 1217, 1218.

It will be readily understood that the examples of FIGS. 19A and 19B are merely representative, and actually represent the extreme cases. By sliding the valve member 1207 into positions between the first and second end positions it is possible to achieve a wide variety of resultant air flows. For example, in the illustrated embodiment, the range through which the resultant airflow generated by the nozzle 1200 can be varied is approximately 44 degrees. Specifically, with the angle ($\alpha$) of the face 1208 relative to the base 1209 of the nozzle 1200 being approximately 35 degrees, and the biasing of the flow towards the front of the nozzle 1200, the nozzle 1200 of the illustrated embodiment can vary the direction ($\gamma$) of the resultant air flow between a first extreme of 37.5 degrees relative to the base 1209 of the nozzle 1200, and second extreme of −6.5 degrees relative to the base 1209 of the nozzle 1200. The direction of the resultant air flows can then be further varied by controlling the oscillation motor 1129 to adjust the angular position of the nozzle body 1201 relative to the body 1100 of the fan assembly 1000.

It will be appreciated that individual items described above may be used on their own or in combination with other items shown in the drawings or described in the description and that items mentioned in the same passage as each other or the same drawing as each other need not be used in combination with each other. In addition, the expression "means" may be replaced by actuator or system or device as may be desirable. In addition, any reference to "comprising" or "consisting" is not intended to be limiting in any way whatsoever and the reader should interpret the description and claims accordingly.

Furthermore, although the invention has been described in terms of preferred embodiments as set forth above, it should be understood that these embodiments are illustrative only. Those skilled in the art will be able to make modifications and alternatives in view of the disclosure which are contemplated as falling within the scope of the appended claims. For example, those skilled in the art will appreciate that the above-described inventions might be equally applicable to other types of environmental control fan assemblies, and not just free standing fan assemblies. By way of example, such a fan assembly could be any of a freestanding fan assembly, a ceiling or wall mounted fan assembly and an in-vehicle fan assembly. In addition, the above-described inventions might be equally applicable to other types of air flow generating devices, or blowers, such as a hairdryer or other hair care appliance.

By way of further example, whilst the valve mechanism described above comprises a single linearly moveable valve member, the valve mechanism could equally comprise a plurality of valve members that cooperate to adjust the size of the first flow vectoring air outlet relative to the size of the second flow vectoring air outlet. To do so, the plurality of valve members may be linked so that they move simultaneously. In addition, whilst the above described embodiment makes use of a manual mechanism for driving the movement of the valve member the nozzle described herein could alternatively include a valve motor for driving the movement of valve member in response to instructions received from the control circuit.

Moreover, the nozzle and the outlets could have different shapes to those described above. For example, rather than having the general shape of a circular arc, the slots that provide the first and second flow vectoring air outlets could each be elongate or could be elliptical arcs. Similarly, rather than having the general shape of a sphere, the nozzle could have the general shape of a cuboid, ellipsoid or spheroid. Rather than being circular, the face of the nozzle could then be square, rectangular, or elliptical.

As a yet further example, whilst in the above described embodiment, the valve member is provided with both asymmetric end stops and an asymmetric profile in order to bias the direction of the resultant air flow towards the front of the nozzle, these features can be used independently of one another. In particular, a degree of bias can be achieved using either asymmetric end stops or an asymmetric profile for the valve member.

The invention claimed is:

1. A nozzle for a fan assembly, the nozzle comprising:

an air inlet;

a first air outlet for emitting an air flow and a second air outlet for emitting an air flow, the first air outlet being opposite the second air outlet, and the first and second air outlets being oriented in convergent directions;

a valve for controlling the first and second air outlets, wherein the valve comprises one or more valve members that are moveable to simultaneously adjust the size of the first air outlet and inversely adjust the size of the second air outlet; and a third air outlet and a fourth air outlet, the third air outlet being opposite the fourth air outlet, the third and fourth air outlets being oriented in convergent directions, and the third air outlet and the fourth air outlet each being substantially perpendicular to each of the first and second air outlets.

2. The nozzle of claim 1, wherein one or more valve members are moveable through a range of positions between a first end position in which the first air outlet is maximally open and the second air outlet is maximally occluded and a second end position in which the first air outlet is maximally occluded and the second air outlet is maximally open.

3. The nozzle of claim 1, wherein the valve is arranged such that a size difference between the first air outlet and the second air outlet when the one or more valve members are in the first end position is greater than a size difference between the first air outlet and the second air outlet when the one or more valve members are in the second end position.

4. The nozzle of claim 1, and further comprising an internal air passageway extending between the air inlet and the first and second air outlets.

5. The nozzle of claim 4, and further comprising a first side duct extending from the internal air passageway to the third air outlet and a second side duct extending from the internal air passageway to the fourth air outlet.

6. The nozzle of claim 1, wherein the valve is arranged such that the size of both the third and fourth outlets is dependent upon the position of one or more valve members.

7. The nozzle of claim 6, wherein the valve is arranged such that movement of the one or more valve members simultaneously adjusts the size of third and fourth outlets.

8. The nozzle of claim 6, wherein one or more valve members are moveable through a range of positions between a first end position in which the first air outlet is maximally open and the second air outlet is maximally occluded and a second end position in which the first air outlet is maximally occluded and the second air outlet is maximally open and wherein the valve is arranged such that both the third and fourth air outlets are maximally open when the one or more valve members are in-between the first end position and the second position.

9. The nozzle of claim 8, wherein the valve is arranged such that both the third and fourth air outlets are maximally occluded when the one or more valve members are in either of the first end position and the second position.

10. The nozzle of claim 6, wherein one or more valve members are moveable through a range of positions between a first end position in which the first air outlet is maximally open and the second air outlet is maximally occluded and a second end position in which the first air outlet is maximally occluded and the second air outlet is maximally open and wherein the valve is arranged such that both the third and fourth air outlets are maximally open when the size of the first air outlet is approximately equal to the size of the second air outlet.

11. The nozzle of claim 10, wherein the valve is arranged such that both the third and fourth air outlets are maximally occluded when the difference in size between the first air outlet and the second air outlet is at a maximum.

12. The nozzle of claim 1, wherein the first air outlet and the second air outlet are provided on a face of the nozzle, and preferably wherein they are oriented towards a central axis of the face of the nozzle.

13. The nozzle of claim 1, wherein the valve comprises a single valve member.

14. The nozzle of claim 13, wherein one or more valve members are moveable through a range of positions between a first end position in which the first air outlet is maximally open and the second air outlet is maximally occluded and a second end position in which the first air outlet is maximally occluded and the second air outlet is maximally open and wherein the valve member is arranged to be moveable between the first end position and the second end position.

15. The nozzle of claim 14, wherein the valve member is arranged such that a first portion of the valve member maximally occludes the second air outlet when in the first end position, and a second portion of the valve member maximally occludes the first air outlet when in the second end position.

16. The nozzle of claim 15, wherein the valve member is arranged such that a third portion of the valve member maximally occludes the third air outlet when in both the first end position and the second end position, and a fourth portion of the valve member maximally occludes the fourth air outlet when in both the first end position and the second end position.

17. The nozzle of claim 16, wherein the valve member is arranged such that the third portion of the valve member minimally occludes the third air outlet when in-between the first end position and the second position, and the fourth portion of the valve member minimally occludes the fourth air outlet when in-between the first end position and the second position.

18. The nozzle of claim 15, wherein the valve member is arranged such that a third portion of the valve member minimally occludes the third air outlet when the size of the first air outlet is approximately equal to the size of the second air outlet, and a fourth portion of the valve member minimally occludes the fourth air outlet when the size of the first air outlet is approximately equal to the size of the second air outlet.

19. The nozzle of claim 18, wherein the valve member is arranged such that the third portion of the valve member maximally occludes the third air outlet when the difference in size between the first air outlet and the second air outlet is at a maximum, and the fourth portion of the valve member maximally occludes the fourth air outlet when the difference in size between the first air outlet and the second air outlet is at a maximum.

20. The nozzle of claim 13, wherein a body of the nozzle defines an opening at a face of the nozzle and the valve member is disposed within the nozzle body adjacent to the opening.

21. The nozzle of claim 20, wherein the valve member comprises an outermost surface at least a portion of which is exposed within the opening defined by the nozzle body.

22. The nozzle of claim 21, wherein the first and second air outlets are diametrically opposed on the face of the nozzle such that the outermost surface extends between the first and second air outlets.

23. The nozzle of claim 21, wherein the first air outlet is defined by a first portion of an edge of the opening at the face of the nozzle and a first portion of the outermost surface of the valve member that is adjacent to the first portion of the edge, and the second air outlet is defined by a second portion of the edge of the opening at the face of the nozzle and a second portion of the outermost surface of the valve member that is adjacent to the second portion of the edge.

24. The nozzle of claim 16, wherein the third and fourth portions of the valve member each comprise an aperture formed in the valve member and that is arranged to be aligned with the corresponding air outlet when the valve member is in-between the first end position and the second position.

25. The nozzle of claim 24, wherein the third and fourth portions of the valve member are each arranged such that the aperture is displaced away from the corresponding air outlet when the valve member is in either of the first end position and the second end position.

26. The nozzle of claim 18, wherein the third and fourth portions of the valve member each comprise an aperture formed in the valve member and that is arranged to be aligned with the corresponding air outlet when the size of the first air outlet is approximately equal to the size of the second air outlet.

27. The nozzle of claim 26, wherein the third and fourth portions of the valve member are each arranged such that the aperture is displaced away from the corresponding air outlet when the difference in size between the first air outlet and the second air outlet is at a maximum.

28. A fan assembly comprising an impeller, a motor for rotating the impeller to generate an air flow, and a nozzle as claimed in claim 1 for receiving the air flow.

* * * * *